US005930557A

United States Patent [19]

Sasahara et al.

[11] Patent Number: 5,930,557

[45] Date of Patent: Jul. 27, 1999

[54] NOISE MASKING SYSTEM AND METHOD IN IMAGE FORMING APPARATUS

[75] Inventors: Shinji Sasahara; Daisuke Yoshino; Yumiko Kurosawa, all of Nakai-machi, Japan

[73] Assignee: Fuji Xerox Co., Ltd., Tokyo, Japan

[21] Appl. No.: 09/078,635

[22] Filed: May 14, 1998

Related U.S. Application Data

[63] Continuation of application No. 08/738,482, Oct. 28, 1996, Pat. No. 5,784,670.

[30] Foreign Application Priority Data

Jan. 22, 1996 [JP] Japan ..... 8-26268

[51] Int. Cl.[6] ..... G03G 21/20

[52] U.S. Cl. ..... 399/91; 381/73.1

[58] Field of Search ..... 399/1, 91, 411; 381/71.1, 71.9, 71.14, 73.1

[56] References Cited

U.S. PATENT DOCUMENTS

| | | | |
|---|---|---|---|
| 3,647,968 | 3/1972 | Arguimbau et al. . | |
| 5,245,385 | 9/1993 | Fukumizu et al. . | |
| 5,289,147 | 2/1994 | Koike et al. . | |
| 5,638,454 | 6/1997 | Jones et al. . | |
| 5,652,799 | 7/1997 | Ross et al. . | |
| 5,784,670 | 7/1998 | Sasahara et al. | 399/91 |

FOREIGN PATENT DOCUMENTS

| | | |
|---|---|---|
| A-63-59797 | 3/1988 | Japan . |
| A-4-221966 | 8/1992 | Japan . |
| A-4-332673 | 11/1992 | Japan . |
| A-4-355797 | 12/1992 | Japan . |
| A-5-142887 | 6/1993 | Japan . |
| A-6-008581 | 1/1994 | Japan . |
| A-6-175443 | 6/1994 | Japan . |

*Primary Examiner*—Robert Beatty
*Attorney, Agent, or Firm*—Oliff & Berridge, PLC

[57] ABSTRACT

A noise masking system in an image forming apparatus such as a laser beam printer or a copying machine having a drive mechanism acting as a noise generation source during operation, the noise masking system comprising a masking sound generator for generating a sound to mask the noise and masking sound control device which controls the masking sound generator to generate a masking sound of a frequency range including a main-component frequency of the noise. The masking sound thus generated is of a frequency range from a lower-limit frequency to an upper-limit frequency in a critical band of the main-component frequency of the noise. The noise masking system masks noise without decreasing the sound pressure of the noise.

5 Claims, 16 Drawing Sheets

| SCORE | UNPLEASANTNESS | SHRILLNESS | NOISINESS |
|---|---|---|---|
| 5 | UNPLEASANT | SHRILL | NOISY |
| 4 | SLIGHTLY UNPLEASANT | SLIGHTLY SHRILL | SLIGHTLY NOISY |
| 3 | NEITHER UNPLEASANT NOR PLEASANT | NEITHER SHRILL NOR CALM | NEITHER NOISY NOR QUIET |
| 2 | SLIGHTLY PLEASANT | SLIGHTLY CALM | SLIGHTLY QUIET |
| 1 | PLEASANT | CALM | QUIET |

| SCORE | 7 | 6 | 5 | 4 | 3 | 2 | 1 |
|---|---|---|---|---|---|---|---|
| UNPLEASANTNESS | VERY UNPLEASANT | FAIRLY UNPLEASANT | SLIGHTLY UNPLEASANT | NEUTRAL | SLIGHTLY PLEASANT | FAIRLY PLEASANT | VERY PLEASANT |
| SHRILLNESS | VERY SHRILL | FAIRLY SHRILL | SLIGHTLY SHRILL | NEUTRAL | SLIGHTLY CALM | FAIRLY CALM | VERY CALM |
| NOISINESS | VERY NOISY | FAIRLY NOISY | SLIGHTLY NOISY | NEUTRAL | SLIGHTLY QUIET | FAIRLY QUIET | VERY QUIET |

FIG. 20

NOISE MASKING SYSTEM AND METHOD IN IMAGE FORMING APPARATUS

This is a Continuation of application Ser. No. 08/738,482 filed Oct. 28, 1996, now U.S. Pat. No. 5,784,670. The entire disclosure of the prior application(s) is hereby incorporated by reference herein in its entirety.

BACKGROUND OF THE INVENTION

1. Field of the Invention

The present invention relates to a noise masking system and method in an image forming apparatus such as, for example, an office automation (OA) apparatus, a laser beam printer, or an electrophotographic copying machine, using drive motors as drive sources for operation. The noise masking system and method according to the present invention generates a masking sound for cancelling noises generated from the drive motors which noises cause an unpleasant feeling.

2. Description of Related Art

In a conventional image forming apparatus such as a laser beam or an electrophotographic copying machine there are used a plurality of mechanical drive motors, which are special drive motors developed along the recent tendency to digitization.

For example, in a digitized image forming apparatus, the reading of an image is performed by scanning an image carrier (original) with a light source, e.g. light emitting diode (LED), and reading the image by a charge coupled device (CCD). For recording an image there is used an image recorder, which scans a recording medium with light beam emitted from a light source, e.g. laser diode, and modulated by an image signal or a character signal and then records the image (prepares an original). In this case, as an optical scanner for the light beam there is used an optical deflector. The optical reflector comprises a rotary polyhedron mirror having a plurality of reflective surfaces on the outer periphery thereof and a drive motor for rotating the said rotary polyhedron mirror. An example of the drive motor used in such an optical deflector will be described below.

FIG. 26 is a perspective view explaining the construction of an optical deflector (optical scanner). In the same figure, numeral 51 denotes a drive motor, numeral 52 denotes a rotary polyhedron mirror, 53 a laser beam source, 54 a collimator lens, 55 a light condensing optical component (condenser lens), and 56 a recording member (photosensitive drum).

The construction of such an optical deflector used in an image forming apparatus, as well as an image recording method, will now be described with reference to FIG. 26. In recording an image, the rotary polyhedron mirror 52 is rotated in the direction of arrow A by the drive motor 51. The laser beam source 53 is constituted by a laser such as a semiconductor laser or a gas laser. Light beam emitted from the laser light source 53 is modulated with an image signal by means of a modulator (not shown) and the thus-modulated light beam is incident on one reflecting mirror surface of the rotary polyhedron mirror 52 through the collimator lens 54. The light beam reflected by the reflecting mirror surface of the rotary polyhedron mirror 52 is projected on the recording member 56 through the light condensing optical component 55. In this case, with rotation of the rotary polyhedron mirror 52 in the direction of arrow A, the reflected light beam is deflected in the direction of arrow B and scans the recording member 56 horizontally. Along with this horizontal scanning, the recording member 56 is rotated in the direction of arrow C, whereby a vertical scanning is performed. In this way a two-dimensional image is written onto the recording member 56.

The drive motor 51 used in such an optical deflector is of the type in which there is used a rotary bearing such as a dynamic pressure air bearing or ball bearing, using one of a sleeve and a shaft both fitted together as a rotating member and the other as a stationary member, and a rotational torque is generated by a magnetic circuit composed of a permanent magnet attached to the rotating member and an electromagnetic coil wound round an annular iron core mounted in the stationary member. Thus, the drive motor 51 has a magnetic circuit functioning also as a magnetic bearing which holds a rotor in the axial direction.

Consequently, when the image recording described above is performed, there arises a noise upon operation of the drive motor 51. A description will now be given of noises which occur with change in the number of revolutions of the drive motor. As shown in FIG. 27, a noise occurs and changes as the number of revolutions of the drive motor in the optical scanner changes. The timing chart of FIG. 27 shows noises occurring in the process from when the power is turned ON until when a series of image forming operations are completed. This change in the noise level is almost the same as the change in the number of revolutions of the drive motor acting as a main component of the drive mechanism. It is FIG. 28 that explains the change in the number of revolutions of the drive motor 51 alone. In FIG. 28, it is not the noise level (dB) but the number of revolutions, f, that is plotted along the axis of ordinate. The value of dB (loudness) itself changes little even with a change in the number of revolutions. A change in the frequency (timbre) of noise which occurs with a change in the number of revolutions is offensive to the ear.

As shown in FIG. 28, upon turning ON of the power, the number of revolutions of the drive motor is increased up to a predetermined value. If a predetermined processing is not started after continuance of the predetermined number of revolutions, a stand-by mode starts, in which the number of revolutions is decreased and the motor assumes a rest state. Thereafter, when the start of the processing is instructed, the drive motor starts to rise, and when the number of revolutions of the drive motor has reached a predetermined value, the drive motor starts to operate for the predetermined processing. Then, upon termination of the operation, some fans stop rotation, and after continuance of rotation for a certain time for cooling, the drive motor starts to slow down. The drive motor slows down to the number of revolutions preset for the stand-by mode, which revolutions are then continued, that is, the drive motor continues to stand by.

Thus, in the image forming apparatus, if no processing is performed for a while after turning ON of the power, a switching is made into the stand-by mode in several to several ten seconds. But this is for diminishing the power consumption during stand-by. Most drive mechanisms in the apparatus, except fans for heat radiation, come into a rest state. In the stand-by mode, the optical deflector is usually slowed down to the half or so of a predetermined number of revolutions. This is for shortening the time required from when the drive motor starts to rise until when its predetermined number of revolutions is reached, in preparation for the regular operation. According to a certain type of image forming apparatus developed recently, the number of revolutions is decreased to even zero in the stand-by mode for the purpose of further diminishing the power consumption in the same mode.

For performing the image forming processing in the stand-by mode, the operator is required, for example, to depress a button on the control panel to input a processing start signal, whereupon the image forming apparatus goes into an operation mode and the drive motor of the optical reflector starts to rise. The revolution of the motor is increased until reaching the predetermined number of revolutions. At this time, the drive motor of the optical reflector is required to rotate at high speed in a short time from the standpoint of an image forming cycle for example. For this reason, the drive motor of the optical deflector is constituted so as to be used at a higher number of revolutions than that of the usual motors. Its number of revolutions is 5,000 or more, or even 10,000 or more as the case maybe. In this case, a large current flows in the drive motor at the leading edge of the motor to increase the number of revolutions rapidly, with the result that a very loud noise occurs. This noise is a fluctuating noise interlocked with the change in the number of revolutions, which is very offensive to the human ear and causes unpleasant feeling.

After the drive motor has reached the predetermined number of revolutions, the image forming processing is started, and after completion of a series of operations, the various mechanisms of the apparatus come into a rest state. In the event the next processing is not performed even after the lapse of a certain time, a switching is made again into the standby mode and the drive motor slows down. The drive motor eventually stops rotation and assumes a complete standby state.

The noise from the motor is a fluctuating noise interlocked with the number of revolutions, but a human becomes aware of the fluctuation because the human is sensitive to a change of sound. Analysis of a frequency spectrum of the fluctuating noise shows that a gentle distribution is present over a wide frequency band and that sharp peaks projecting from the base spectrum are present in several frequency bands. It is seen that the said sharp peaks fluctuate. Among the sharp peaks, a main-component frequency, which is high in sound pressure level, ranges from several hundred Hz to several kHz. The sound in this frequency band gives rise to a great unpleasant feeling because the human is auditorily sensitive to such sound. That is, this sound is a fluctuating noise of high frequency which causes shrillness. If one hears this fluctuating noise, he recognizes it as a very unpleasant noise because of shrillness.

Heretofore there have been proposed techniques for suppressing this type of unpleasant noises caused by frequency fluctuation, such as, for example, those proposed in Japanese Published Unexamined Patent Application Nos. Sho 63-59797 and Hei 6-175443. According to the "step motor driving method" proposed in Japanese Published Unexamined Patent Application No. Sho 63-59797, the change with time of frequency at the leading edge of a drive motor is like plural curves to mitigate an abrupt change. In the "image forming apparatus" proposed in the Japanese Published Unexamined Patent Application No. Hei 6-175443, at the leading edge of a polygon mirror driving motor, another operation noise is caused to fall down forward to cover the operation noise of the motor, thereby making the motor noise difficult to hear (masking).

According to the above conventional methods, a design is made so that the change of frequency with time describes plural curves in order to eliminate a psychological unpleasant feeling caused by noise at the leading edge of the drive motor in the optical deflector. This construction is somewhat effective in mitigating an abrupt change of sound, but cannot eliminate unpleasant feeling because the frequency fluctuation is almost recognized.

According to the above conventional method in which the motor operation noise is covered with another operation noise to make it difficult to hear, the noise (sound volume) as a whole further increases and causes noisiness. Thus, it is impossible to eliminate unpleasant feeling. Besides, other portions of the image forming apparatus are separately operated continuously during the period from turning ON of the power or termination of the image forming processing until switching into the stand-by mode. This is undesirable from the standpoint of low power consumption.

SUMMARY OF THE INVENTION

The present invention has been accomplished for solving the various problems mentioned above, and it is an object of the invention to provide a noise masking system in an image forming apparatus of small size and low cost such as, for example, a laser printer or a copying machine, capable of masking noise so as to eliminate a psychological unpleasant feeling caused by frequency fluctuation.

In order to achieve the above-mentioned object, in the first aspect of the present invention there is provided a noise masking system in an image forming apparatus having a drive mechanism which causes noise during operation, the noise masking system is characterized by including a masking sound generator for generating a sound to mask the noise and masking sound control means for controlling the said masking sound generator to generate a masking sound having a frequency of a range including a main-component frequency of the noise.

According to the present invention, in the second aspect thereof, there is provided a noise masking system in combination with that in the first aspect, characterized in that the masking sound control means is sound control means which generates a masking sound having a frequency of the range from a lower-limit frequency to an upper-limit frequency of a critical band frequency in the main-component frequency of the noise.

According to the present invention, in the third aspect thereof, there is provided a noise masking system in combination with that in the first or second aspect, characterized in that the masking sound generated by the masking sound control means or the sound control means is a noise type masking sound not having any outstanding sound pressure peak in a specific frequency. In the fourth aspect of the invention, the said masking sound is a pure tone type masking sound having an outstanding sound pressure peak in the specific frequency.

According to the present invention, in the fifth aspect thereof, there is provided a noise masking system in an image forming apparatus in combination with that in the third aspect, characterized in that the frequency and sound pressure of the noise type masking sound are in an inverse proportion to each other. In the sixth aspect of the present invention, the sound pressure distribution of the pure tone type masking sound relative to the frequency is either a triangular distribution or a normal distribution. In the seventh aspect of the invention, the frequency distribution of the pure tone type masking sound is a symmetric distribution with the foregoing specific frequency as the center.

According to the present invention, in the eighth aspect thereof, there is provided a noise masking method in an image forming apparatus having a drive mechanism which causes noise during operation, characterized in that a masking sound having a frequency of a range including a main-component frequency of the noise is generated from a masking sound generator.

According to the present invention, in the ninth aspect thereof, there is provided a noise masking method in an image forming apparatus having a drive mechanism which causes noise during operation, characterized in that a masking sound having a frequency of the range from a lower-limit frequency to an upper-limit frequency of a critical band frequency in a main-component frequency of the noise is generated from a masking sound generator.

According to the present invention, in the tenth aspect thereof, there is provided a noise masking method in combination with that in the eighth or ninth aspect, characterized in that the masking sound is a noise type masking sound not having any outstanding sound pressure peak in a specific frequency. In the eleventh aspect of the invention, the masking sound is a pure tone type masking sound having an outstanding sound pressure peak in the specific frequency. In the twelfth aspect of the invention, the frequency and sound pressure of the noise type masking sound are in inverse proportion to each other.

According to the present invention, in the thirteenth aspect thereof, there is provided a noise masking method in an image forming apparatus in combination with that in the eleventh aspect, characterized in that the sound pressure distribution of the pure tone type masking sound relative to the frequency is either a triangular distribution or a normal distribution. In the fourteenth aspect of the invention, the frequency distribution of the pure tone type masking sound is a symmetric distribution with the foregoing specific frequency as the center.

According to the present invention, in the fifteenth aspect thereof, there is provided a noise masking system in an image forming apparatus having a drive mechanism which causes noise during operation, characterized by including correlation signal producing means for producing a correlation signal correlated with the noise, a masking sound generator for generating a noise type masking sound to mask the noise, and masking sound control means for controlling the masking sound generator to vary the noise type masking sound in response to a change of the correlation signal.

According to the present invention, in the sixteenth aspect thereof, there is provided a noise masking method in an image for making apparatus having a drive mechanism which causes noise during operation, characterized in that a correlation signal correlated with the noise is produced and a masking sound generator for generating a noise type masking sound to mask the noise is controlled to vary the noise type masking sound in response to a change of the correlation signal.

Thus, in the noise masking system in an image forming apparatus according to the present invention, which has such various features as mentioned above, there are used a masking sound generator for generating a masking sound to mask the noise and masking sound control means. Against a fluctuating noise of the noise generated from the drive mechanism during operation, the masking sound control means controls the masking sound generator to generate a masking sound having a frequency of a range including a main-component frequency of the noise, thereby masking the fluctuating noise to diminish unpleasant feeling caused by the noise.

In this case, the masking sound control means uses sound control means to generate, for example, a masking sound having a frequency of the range from a lower-limit frequency to an upper-limit frequency of a critical band frequency in a main-component frequency of the noise. More specifically, a noise is produced which is band-limited so as to contain a main-component frequency of noise generated at the leading edge to a predetermined number of revolutions of the drive motor or at the trailing edge, and the band-limited noise is generated as a sound wave from a speaker to prevent fluctuation of the main-component frequency from being recognized as noise.

According to one mode, the masking sound generated by the masking sound control means or the sound control means is a noise type masking sound not having any outstanding sound pressure peak in a specific frequency, while according to another mode it is a pure tone type masking sound having an outstanding sound pressure peak in the specific frequency. The use of a noise type masking sound is advantageous in that a fluctuating noise of the noise generated at the leading or trailing edge of the drive motor becomes difficult to be recognized. Further, by generating a pure tone type masking sound having an outstanding sound pressure peak in the specific frequency during generation of the fluctuating noise, the fluctuating noise is masked by such a masking sound and becomes difficult to be recognized in the auditory sense.

The frequency and sound pressure of the noise type masking sound are made inversely proportional to each other, that is, the distribution of power on the frequency shaft of a band-limited noise is given a form in which it is inversely proportional to frequency, thereby preventing the added band-limited noise from being recognized. Moreover, the distribution of sound pressure of the noise type masking sound relative to frequency is a distribution selected from triangular distribution, trapezoidal distribution and normal distribution, whereby the auditory sensitivity to frequencies spaced apart from the main-component frequency is suppressed to render the band-limited noise less audible and prevent recognition of the noise based on the main-component frequency.

In this case, the frequency distribution of the noise type masking sound may be a symmetric distribution with the foregoing specific frequency as the center. Even by so doing, the auditory sensitivity of frequencies spaced apart from the main-component frequency can be suppressed to render the band-limited noise less audible and it is possible to keep the sound based on the main-component frequency out of recognition.

In the noise making system in an image forming apparatus according to the present invention, the noise as a frequency fluctuating noise at the leading or trailing edge of revolution of the drive motor becomes difficult to be recognized auditorily, whereby a psychological unpleasant feeling is suppressed. The noise created as a masking sound and band-limited can diminish unpleasant feeling without recognition of an increase of noise.

Regarding to what degree the frequency fluctuation of the main-component frequency is to be recognized and to what degree the increase of noise is to be recognized by the addition of the band-limited noise, the operator can adjust them by making operations on the control panel. The fluctuating noise of the main-component frequency in the drive motor can be set to the extent of not being recognized by the operator and people present thereabouts, thereby diminishing their unpleasant feeling.

In the noise masking system according to the present invention, moreover, the amplitude of a sound which amplitude corresponds to an average amplitude of the band-limited noise added as a masking sound is maintained in a predetermined state under varying environments and conditions, whereby the suppression of unpleasant feeling can be effected stably. Alternatively, by making adjustment so that the distribution of the added band-limited noise is given an inversely proportion form to frequency, it is possible to diminish the degree of recognition of noise increase based on the addition of the band-limited noise.

In the noise masking system according to the present invention, by changing the band and band width of noise following variation in the main-component frequency of the drive motor, it becomes possible to decrease the bandwidth of noise. Consequently, the degree of recognition of noise increase based on the addition of the band-limited noise can be further diminished. Moreover, by optimizing the band, amplitude and distribution of noise in such a manner that the frequency band of the band-limited noise to be added is equal to the critical band of the main-component frequency in the drive motor and that the noise energy is equal to the energy of the main-component frequency, it becomes possible to minimize the recognition degree for frequency fluctuation of the main-component frequency and the degree of recognition of noise increase based on the addition of the band-limited noise.

Further, in the noise masking system according to the present invention, it is possible to make difficult the recognition of noise generated at the transition from fluctuation to steady state or from steady state to fluctuation of the main-component frequency in the drive motor, whereby the sense of incongruity induced by the shift of sound to an ON or OFF state of the motor can be eliminated. Besides, since the noise of the drive motor is not covered with an operation noise or a partial operation noise, it is not necessary to make the noise duration time long, nor is it necessary to provide electric power for operation. Additionally, in comparison with the reduction of noise at the source, using a complicated structure, and the use of the expensive silencer, it is possible to attain a system configuration of simple structure and low cost.

BRIEF DESCRIPTION OF THE DRAWINGS

FIG. 20 is a diagram explaining as seven-stage criterion used in the category evaluation method;

DESCRIPTION OF THE PREFERRED EMBODIMENTS

A plurality of embodiments of the present invention will be described concretely hereinunder with reference to the accompanying drawings. It is to be understood, however, that the present invention is not limited to those embodiments and that although the generation of an addition sound in the following embodiments will be at the leading edge of a drive motor, it is also the same at the trailing edge of the motor, both being different only in point of time.

Figure 1:
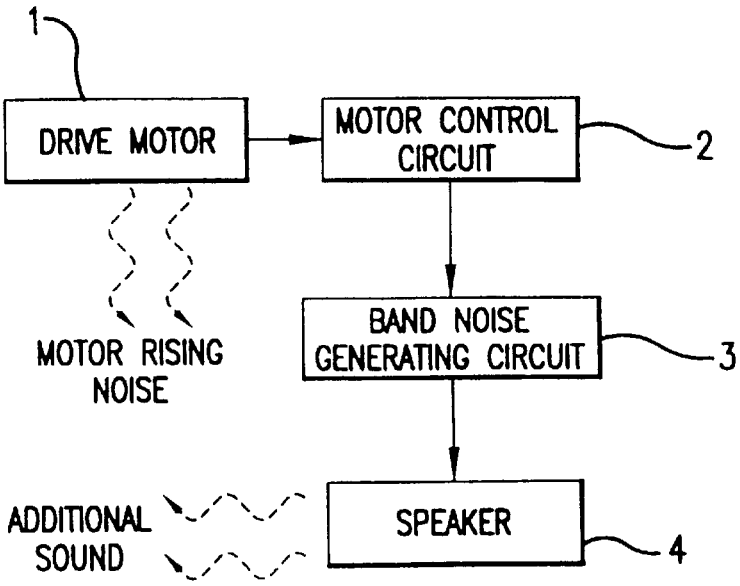
FIG. 1 is a block diagram explaining the construction of a noise masking system in an image forming apparatus according to a first embodiment of the present invention.

Reference will first be made to the first embodiment of the present invention. FIG. 1 is a block diagram explaining the construction of a noise masking system in an image forming apparatus according to the first embodiment. In the same figure, the numeral 1 denotes a drive motor, numeral 2 denotes a motor control circuit, 3 a band noise generating circuit, and 4 a speaker.

In the block diagram of the noise masking system shown in FIG. 1, the motor control circuit 2, for controlling the number of revolutions of the drive motor 1, acquires a signal related to the number of revolutions from the drive motor. For example, if the drive motor 1 is of the type which uses a magnetic force created by a permanent magnet as a drive source, then the magnetic flux density around the permanent magnet is measured, the number of N-S pole switchings is detected from the number of zero points of the flux density, and the quotient obtained by dividing the number of N-S pole switchings by the number of poles of the permanent magnet is obtained as a revolution signal of the drive motor 1.

An output signal from the motor control circuit 2 is fed to the band noise generating circuit 3, which passes the generated noise through a predetermined filter to obtain a band-limited noise as a band noise and provides the band noise to the speaker 4. With a change in the number of revolutions of the drive motor 1 as a trigger and using the band noise provided from the band noise generating circuit 3 as an additional sound (masking sound) against the generated noise, the speaker 4 generates a sound wave in response to the rising noise of the drive motor.

Figure 2:
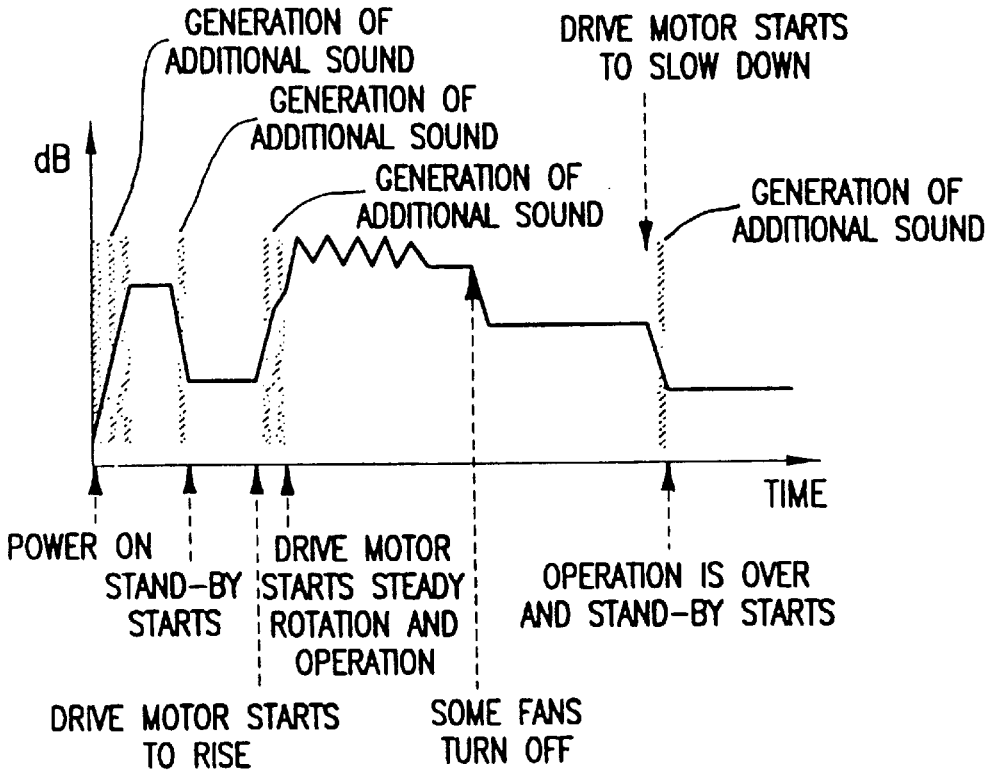
FIG. 2 is a diagram explaining an additional sound generation timing against noise of a drive motor.

Description is now directed to the flow of processing performed for masking the motor rising noise. FIG. 2 is a diagram explaining an additional sound generation timing against the noise generated from the motor. In the same figure, hatched portions indicate additional sound generation timings responsive to the generation of noise at operation timings of the motor. Upon turning ON of the power, first, the revolution of the drive motor rises and is increased up to a predetermined number of revolutions, as shown in FIG. 2. At this time, there occurs a noise based on frequency fluctuation which noise causes unpleasant feeling, and therefore a first additional sound is generated during this period. When the predetermined number of revolutions of the motor has been reached, the rotation of the motor is continued at this constant number of revolutions. If this state is not followed by any processing, a stand-by mode is started, in which mode the number of revolutions is decreased and the motor assumes a rest state. But also in the course of decreasing the number of revolutions there occurs a noise based on frequency fluctuation which noise causes unpleasant feeling, and therefore a second additional sound is generated at this time point.

When the start of processing such as image recording is instructed after the stand-by mode which has been continued at a constant small number of revolutions, the drive motor starts to rise, and when its revolution has reached a predetermined number of revolutions, the operation of the motor for the said processing is started. Here again, in the course of increasing the number of revolutions there occurs a noise based on a large frequency fluctuation which noise causes unpleasant feeling, and therefore a third additional sound is generated during this period. When the processing such as image recording is completed and the operation of the drive motor is over, the rotation of some fans is stopped and the number of revolutions of the motor is decreased for the reduction of electric power, allowing rotation to be continued for a certain time. During this period, that is, in the course of decreasing the number of revolutions, there occurs little frequency fluctuation, so there is not generated any additional sound. After the rotation has been continued for a certain time, the drive motor starts to slow down and its revolution decreases to the stand-by revolution, at which the stand-by state is continued. During this period, that is, in the course of rapidly decreasing the number of revolutions, there occurs a noise based on frequency fluctuation which noise causes unpleasant feeling, and therefore a fourth additional sound is generated also during this period.

Thus, at the time of change in the number of revolutions of the drive motor there occurs a fluctuating noise based on frequency fluctuation, which noise cause unpleasant feeling. Therefore, at every generation of such a noise there is produced an additional sound (the first to the fourth additional sound) to mask the fluctuating noise in response to frequency fluctuation in the number of revolutions of the motor.

Reference will now be made to the relation between the change of an additional sound with time and frequency. Mainly three kinds of noises are usually generated from the drive motor 1, which are an electromagnetic noise generated from an electromagnetic coil or from an iron core at the time of switch-over of an electric current flowing in the drive motor, a wind striking noise created by the friction between a rotary polyhedron mirror and air, and a bearing noise created by a mechanical shaft-bearing contact. The electromagnetic noise is close to a pure tone having sharp peaks in a narrow frequency band. The wind striking noise is a hydraulic noise having gentle peaks in a wide frequency band. And the bearing noise is close to a pure tone having many sharp peaks according to the shape and size in the case of using a ball bearing, which noise is not generated in the use of an air bearing. It is known that the frequencies of these noises are in a proportional relation to the number of revolutions of the drive motor.

Figure 3:
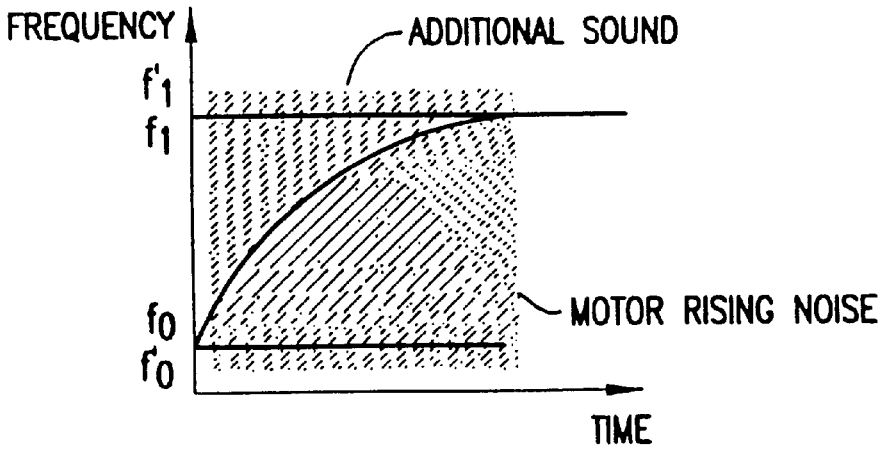
FIG. 3 is a diagram showing a relation between the change of an additional sound with time and a motor rising noise.

FIG. 3 is a diagram showing a relation between the change of an additional sound with time and the motor rising noise. In the same figure, the curve expressed by a solid line represents the change of a main-component frequency of noise which occurs at the leading edge of rotation of the drive motor 1. The main-component frequency indicates a frequency of a high sound pressure level detected by frequency-analysis of the noise generated from the motor, which frequency is in corresponding relation to the number of revolutions of the drive motor. The rotation of the drive motor rises from a zero revolution or from a stand-by mode in which the revolution is not zero. Therefore, as shown in FIG. 3, the frequency of the motor rising noise increases with the change of time. This frequency fluctuating pure tone causes unpleasant feeling.

On the other hand, as shown also in FIG. 3, the additional sound is a band-limited nose as indicated by hatching, whose frequency band is limited to the range from a leading-edge frequency $f_0$ of the main-component frequency to a post-rise frequency $f_1$. More specifically, the additional sound is a noise constituted by waves of a predetermined amplitude and of random frequencies and random phases falling under the range from a lower-limit frequency $f'_0$ of a critical band frequency in leading-edge frequency $f_0$ to an upper-limit frequency $f'_1$ of the critical band frequency in the post-rise frequency $f_1$.

Figure 4A:
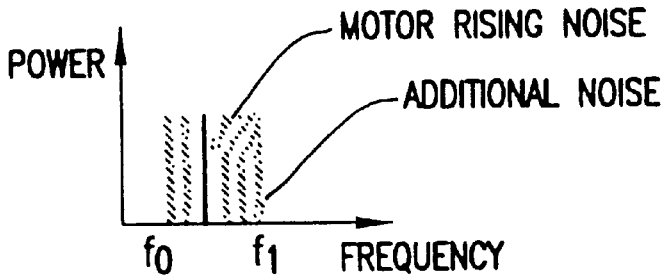
FIG. 4 is a diagram explaining a frequency distribution of a band-limited noise as an additional sound.
Figure 4B:
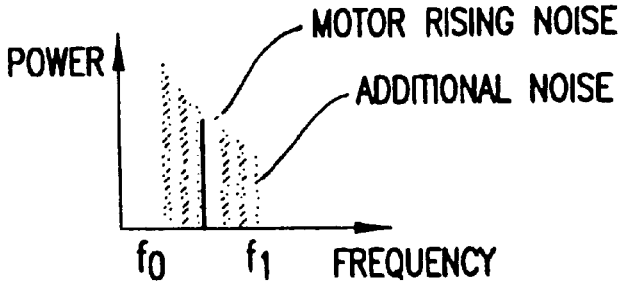

The thus band-limited noise has such a frequency distribution (probability distribution of frequency) as shown in FIG. 4(*a*) in which frequency is plotted along the axis of abscissa and the intensity of noise component plotted along the axis of ordinate. In FIG. 4(*a*), a main-component frequency generated at the leading edge of revolution of the motor, indicated with a solid line, fluctuates in frequency from $f_0$ to $f_1$. At this time, the main-component frequency becomes indistinguishable from the band-limited noise as an additional sound, so that fluctuation of the main-component frequency is difficult to be detected. Besides, since the added noise is band-limited, there is little increase of the noise volume. Consequently, the so-called "noisiness" is difficult to be detected in the auditory sense.

Further, as shown in FIG. 4(*b*), the band-limited noise as an additional sound is given a distribution form in which the noise component intensity is in inverse proportion to frequency. As a result, by the effect of "(l/f) fluctuation," it becomes more difficult to detect an increase of noise auditorily. Consequently, it becomes audible pleasantly. It has been made clear through various studies that sounds having a distribution form in which fluctuating intensities are in inverse proportion to fluctuating frequencies, namely, the so-called "(l/f) fluctuation," are usually felt comfortable to human. The effect of the "(l/f) fluctuation" is here utilized.

Generally, the motor control circuit 2 controls the drive motor 1 in such a manner that at the initial stage of rise a larger current than in the steady state is allowed to flow in the motor in order to shorten the rise time of the motor, while when the motor revolution approaches a predetermined number of revolutions, the electric current is adjusted small in order to diminish overshoot. This fluctuating noise of high frequency which varies with the lapse of time causes a psychological unpleasant feeling. In this connection, since the frequency generated at the leading edge of revolution of the drive motor 1 is a high frequency of a narrow band and fluctuates, it is recognized easily.

In this case, therefore, a band-limited noise which contains a main-component frequency of the fluctuating noise is added and the main-component frequency is allowed to merge into the fluctuating noise, making the fluctuating noise of the main-component frequency itself difficult to be recognized to diminish the unpleasant feeling. However, if an increase of the noise volume is recognized as a result of addition of such additional noise, the unpleasant feeling may be rather enhanced. Therefore, it is necessary that the addition of the band-limited noise be kept to a minimum required level. If the amplitude distribution of the band-limited noise on the frequency axis is rendered inversely proportional to frequency, the foregoing "(l/f) fluctuation" takes effect, so that it becomes more difficult to detect the increase of noise and the noise becomes audible pleasantly.

Figure 5:
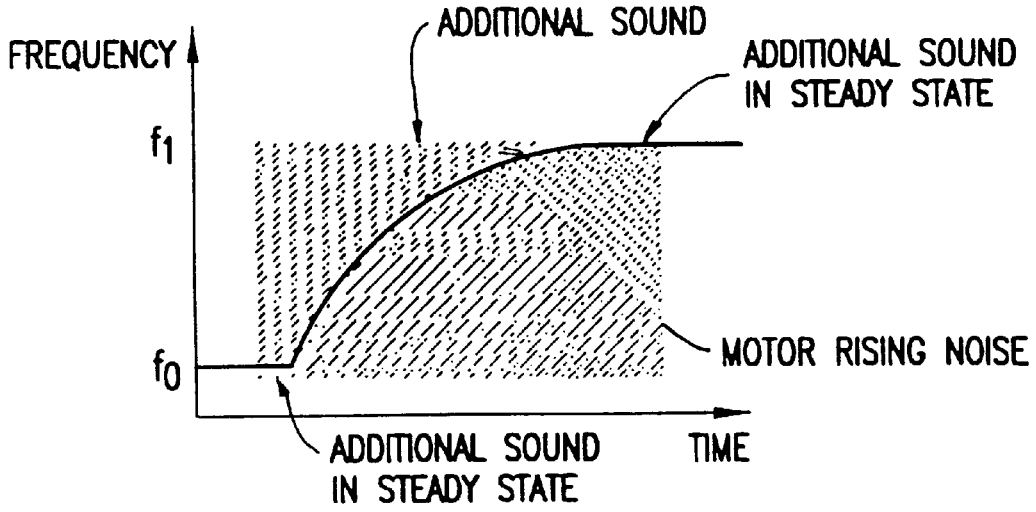
FIG. 5 is a diagram showing a relation between the change of an additional sound with time, including the state thereof up to a steady operation, and a motor rising noise.

Moreover, as shown in FIG. 5, if the band-limited noise as an additional sound is added continuously from just before the rise of fluctuating noise generated at the leading edge of revolution of the drive motor to the subsequent steady sound, it becomes possible to make the noise recognition more difficult.

FIG. 5 is a diagram showing a relation between the change of an additional sound with time, including its state up to steady operation, and a motor rising noise. In the case where a band-limited noise is added as an additional sound to a pure tone type rising noise, the fluctuation of a fluctuating main-component frequency is difficult to be recognized and the change in the way of feeling involves no sense of incongruity if it falls under the frequency band of the added noise even if the main-component frequency fluctuates with the lapse of time as mentioned previously. In this case, by continuing the addition of the band-limited noise from just before the rise of the fluctuating noise up to part of the subsequent steady state, as shown in FIG. 5, it is possible to make the frequency fluctuation further difficult to be recognized.

In the case where a band-limited noise is added as an additional sound to the fluctuating noise generated at the leading edge of revolution of the drive motor to mask the motor rising noise as in this embodiment, the evaluation of the masking effect depends on the auditory sense of each individual person, so it is preferred that the loudness of the additional sound be adjustable. This is attained in the second embodiment of the invention as will be described below.

Figure 6:
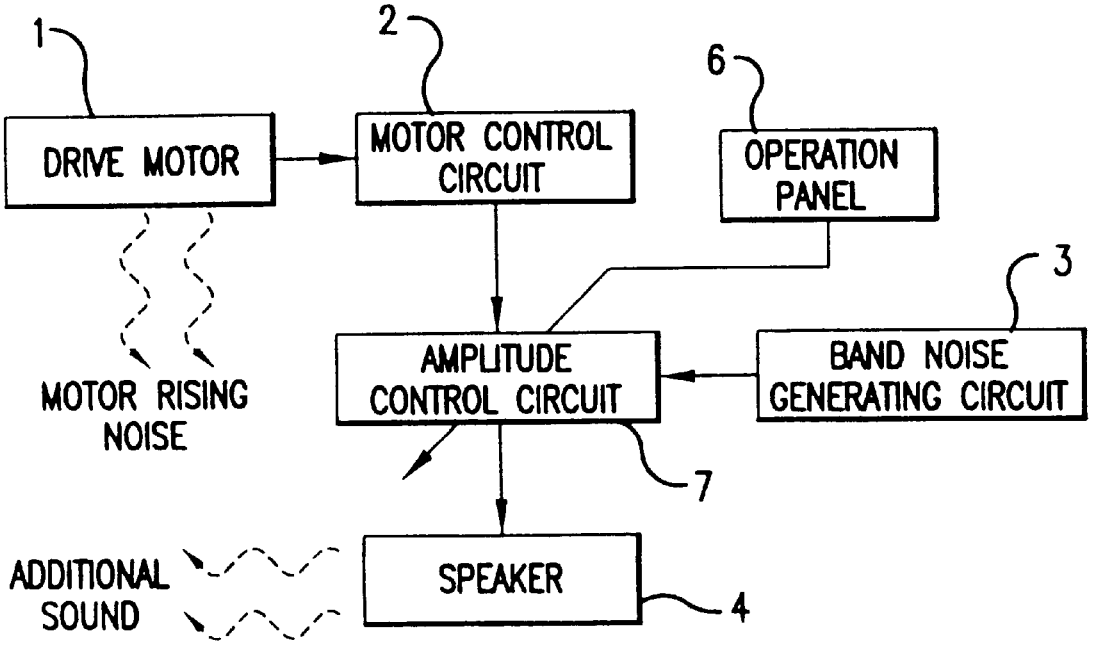
FIG. 6 is a block diagram explaining the construction of a noise masking system in an image forming apparatus according to a second embodiment of the present invention.

FIG. 6 is a block diagram explaining the construction of a noise masking system in an image forming apparatus according to the second embodiment of the present invention. In the same figure, the numeral 1 denotes a drive motor, numeral 2 denotes a motor control circuit, 3 a band noise generating circuit, and 4 a speaker. These components are the same as in the first embodiment (FIG. 1). Further, the numeral 6 denotes a control panel and numeral 7 denotes an amplitude changing circuit.

The noise masking system in an image forming apparatus according to the second embodiment of the present invention will now be described with reference to the block diagram of FIG. 6. In the second embodiment, the control panel 6 and the amplitude changing circuit 7 are newly provided. The band noise generating circuit 3 provides a band-limited noise to the amplitude changing circuit 7, which in turn adjusts the amplitude of the band-limited noise as an additional sound in accordance with a command issued from the control panel 6.

The control panel 6 sends a signal of designating a desired amplitude of the additional sound to the amplitude changing circuit 7. More particularly, the operator designates a desired amplitude on the control panel 6 and a related signal is transmitted from the same panel to the amplitude changing circuit 7. In accordance with this signal the circuit 7 changes the amplitude distribution of the band noise generated by the band noise generating circuit 3 and causes the speaker 4 to generate an additional sound as a sound wave. The operator designates the amplitude to adjust the degree of noise recognition so that the noise of a main-component frequency is not recognized by the operator and people present around the operator. In this way it is possible to suppress unpleasant feeling for each individual person.

In the case where a noise which has been band-limited to the frequency range of a fluctuating noise of the main-frequency component of a drive motor rising noise is added to the motor rising noise to mask it, the second embodiment adopts a method in which the loudness of the added noise can be adjusted according to an auditory desire of each individual person. However, this method is complicated because the adjustment must be made separately for each noise. In order to eliminate this complicatedness it is possible to constitute the noise masking system so as to make the adjustment in question automatically. That is, it becomes possible to adjust the amplitude of the additional sound as a noise masking sound. As to a more minute adjustment, this may be done according to the desire of each individual person. The following description is now provided about a noise masking system having such a construction as the third embodiment of the invention.

Figure 7:
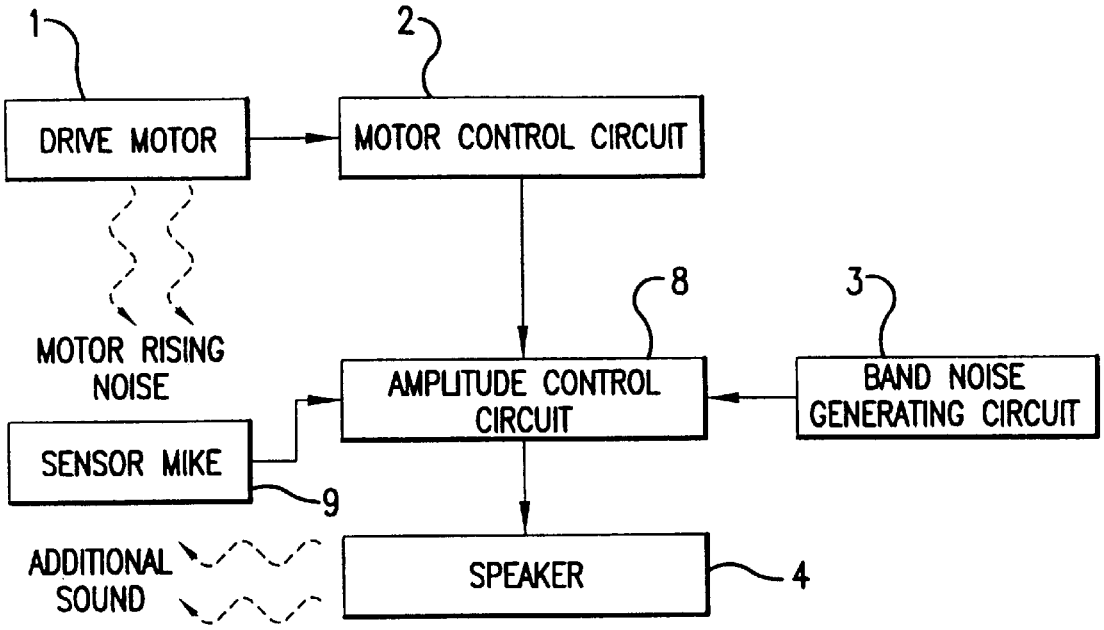
FIG. 7 is a block diagram explaining the construction of a noise masking system in an image forming apparatus according to a third embodiment of the present invention.

FIG. 7 is a block diagram explaining the construction of a noise masking system in an image forming apparatus according to the third embodiment of the present invention. In the same figure, the numeral 1 denotes a drive motor, numeral 2 denotes a motor control circuit, 3 a band noise generating circuit, and 4 a speaker. These components are the same as in the first embodiment (FIG. 1). Further, the numeral 8 denotes an amplitude control circuit and numeral 9 denotes a sensor mike for sensing a motor rising noise.

The noise masking system in an image forming apparatus according to the third embodiment of the invention will now be described with reference to the block diagram of FIG. 7. In third embodiment, the amplitude control circuit 8 and the sensor mike 9 are provided in addition of the components used in the first embodiment. The sensor mike 9 senses a motor rising noise and the amplitude control circuit 8 adjusts the amplitude of an additional sound automatically in accordance with a signal obtained by sensing the motor rising noise. More specifically, the noise masking system of this embodiment is constituted in such a manner that the amplitude of the addition sound, which is a band-limited noise, supplied to the amplitude control circuit 8 from the band noise generating circuit 3 is adjusted automatically by the amplitude control circuit 8 in accordance with the detected output provided from the sensor mike 9.

Thus, in the third embodiment illustrated in FIG. 7, the construction of the second embodiment illustrated in FIG. 6 is further developed and there is provided the sensor mike 9 for sensing the amplitude of a motor rising noise and also provided is the amplitude control circuit 8 corresponding to the amplitude changing circuit 7 used in the second embodiment. In this construction, the amplitude of a main-component frequency of a motor rising noise is detected by the sensor mike 9, which in turn sends the detected signal to the amplitude control circuit 8. The amplitude control circuit 8 controls an increase or decrease of amplitude actively as the main-component frequency fluctuates with the lapse of time. In this way it is possible to maintain the amplitude in a predetermined state and effect the suppression of unpleasant feeling stably in response to environment-induced changes of the main-component frequency and changes of various conditions.

Thus, against the noise generated at the leading edge of revolution of the drive motor, a noise which has been band-limited to the frequency range of a fluctuating noise of the main-component frequency in the motor rising noise is added to mask the motor rising noise so as to decrease the degree of its recognition. In this case, if the suppression of unpleasant feeling can be done stably, it is preferred that the loudness of the added noise as a whole be as small as possible, whereby the degree of "noisiness" which a human feels can be decreased to a greater extent. For example, therefore, if the band component of the added noise is rendered corresponding to the fluctuation of the main-component frequency in the motor rising noise, it becomes possible to obtain a satisfactory masking effect even if the amplitude of the added noise is further diminished. A noise masking system having such a construction will be described below as the fourth embodiment of the invention.

Figure 8:
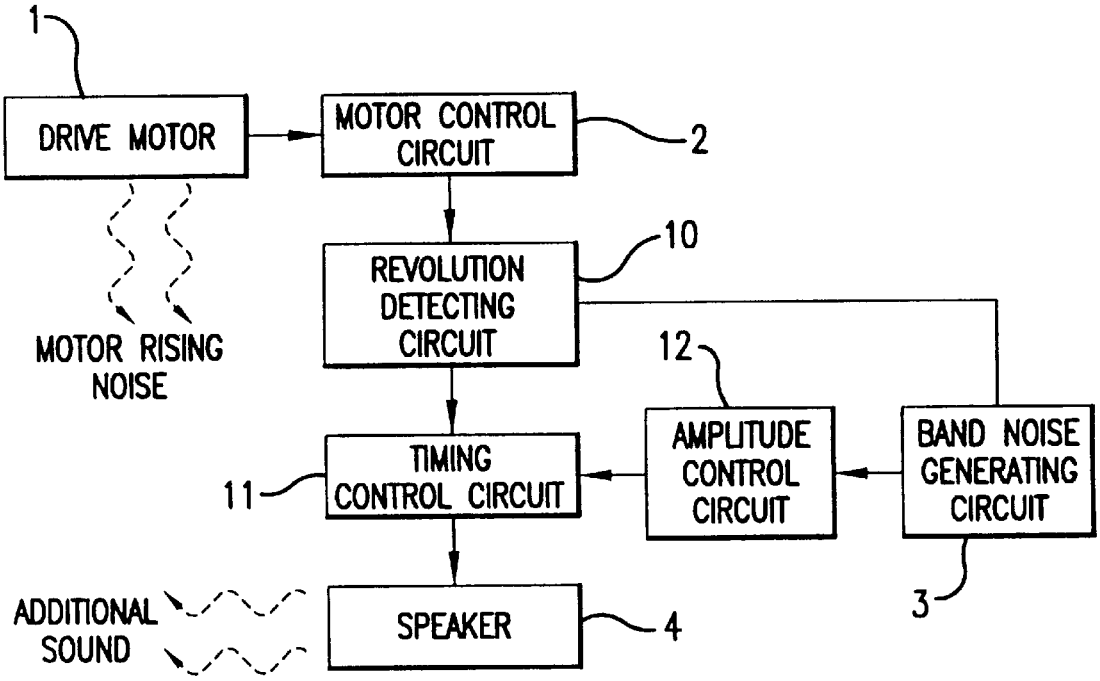
FIG. 8 is a block diagram explaining the construction of a noise masking system in an image forming apparatus according to a fourth embodiment of the present invention.

FIG. 8 is a block diagram explaining the construction of a noise masking system in an image forming apparatus according to the fourth embodiment of the invention. In the same figure, the numeral 1 denotes a drive motor, numeral 2 denotes a motor control circuit, 3 a band noise generating circuit, and 4 a speaker. These components are the same as in the first embodiment (FIG. 1). Further, the numeral 10 denotes a revolution detecting circuit, numeral 11 denotes a timing control circuit, and numeral 12 denotes an amplitude control circuit.

The noise masking system of the fourth embodiment will now be described with reference to the block diagram of FIG. 8. In this fourth embodiment the revolution detecting circuit 10, timing control circuit 11 and amplitude control circuit 12 are newly provided. In accordance with a signal provided from the motor control circuit 2 the revolution detecting circuit 10 detects the number of revolutions of the drive motor and thereby detects fluctuation of a main-component frequency contained in the noise generated at the leading edge of revolution of the motor. The amplitude of a band-limited noise fed from the band noise generating circuit 3 is adjusted in the amplitude control circuit 12 and the so-adjusted noise is provided to the timing control circuit 11. With the signal detected by the revolution detecting circuit 10 as a trigger signal, the timing control circuit 11 transmits the noise whose amplitude has been adjusted by the amplitude control circuit 12 to the speaker 4, which in turn generates a sound wave as an additional sound. In this case, the signal from the revolution detecting circuit 10 is applied continually to the band noise generating circuit 3, which circuit 3 makes a band limitation in a successive manner so that a wide band of noise becomes equal in its band to the critical band of the main-component frequency in the motor rising noise.

In this band limitation, with the main-component frequency, f, in the drive motor 1 as the center, a band width Δfc in question is expressed by the following equation 1:

$$\Delta fc=25.0+75.0\{1.0+1.4(f/1000)^2\}^{0.69} \quad \text{[Equation 1]}$$

Figure 9:
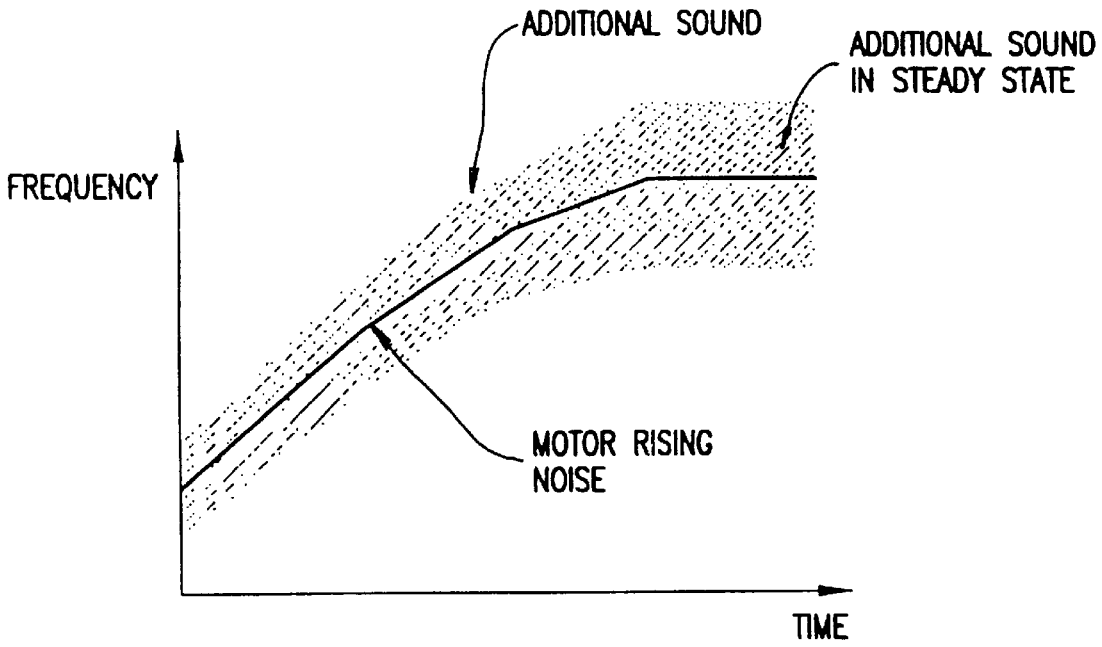
FIG. 9 is a diagram showing a relation between a motor rising noise and a band-limited noise.

In the amplitude control circuit 12, the noise amplitude is controlled so that the power of the band noise (band-limited noise) becomes equal to the power of the main-component frequency in the drive motor 1 which is pre-stored. In this case, the power of the band noise is expressed by the following equation 2:

$$P=10\log_{10}10^{(B(f)/10)}df \quad \text{[Equation 2]}$$

where B(f) stands for an effective value of amplitude at the band noise frequency f. In this case, the motor rising noise and the band noise are in such a relation as shown in FIG. 9.

Figure 10A:
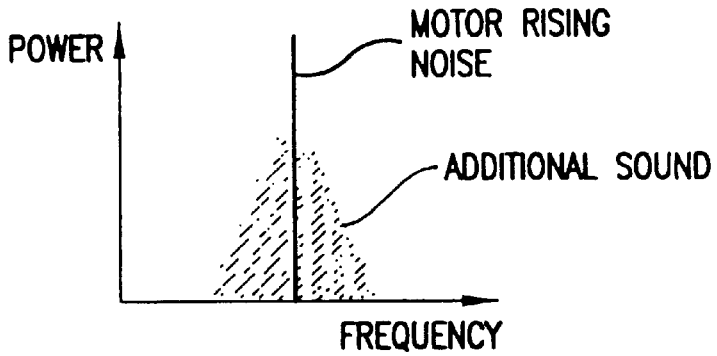
FIG. 10 is a diagram explaining distribution forms on a frequency axis of band-limited noises used as masking sounds.
Figure 10B:
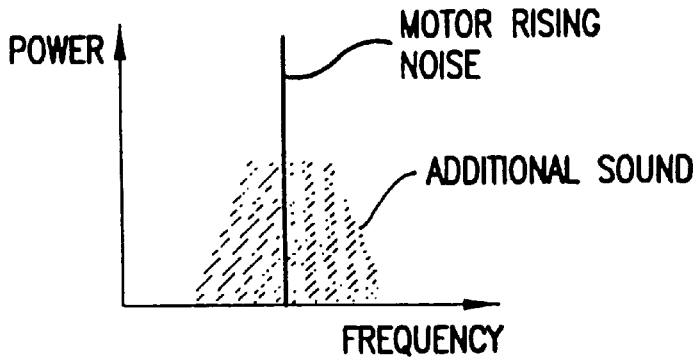
Figure 10C:
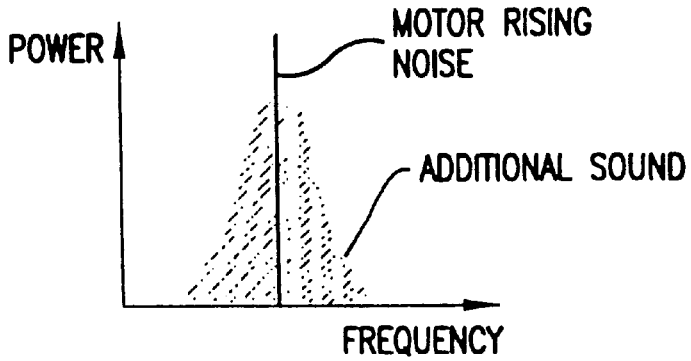

As to the band noise distribution on the frequency axis, a distribution which becomes smaller as the main-component frequency goes away, tends to audible better. In view of this point, for example such triangular, trapezoidal and normal distributions as shown in FIGS. 10(*a*), 10(*b*) and 10(*c*), respectively, are utilized as distributions on the band noise frequency axis.

The band noise produced as a distribution having any of such distribution forms on the frequency axis is fed to the amplitude control circuit 12 from the band noise generating circuit 3, in which the amplitude of the band noise is controlled. The band noise is then fed to the timing control circuit 11, which in turn causes a sound wave to be generated as an additional sound from the speaker 4 in synchronism with the change in the number of revolutions of the drive motor 1. In this case, it is known that in the critical band of the band-limited noise and in a minimum required region of the noise influential in the main-component frequency, the main-component frequency gets mixed with the band noise when the power of the band noise and that of the main-component frequency become equal to each other, resulting in the motor rising noise becoming no longer audible. At this time, the power of the added noise becomes minimum and the detection of noise increase is minimized.

EXPERIMENT 1

Figures 11, 12:
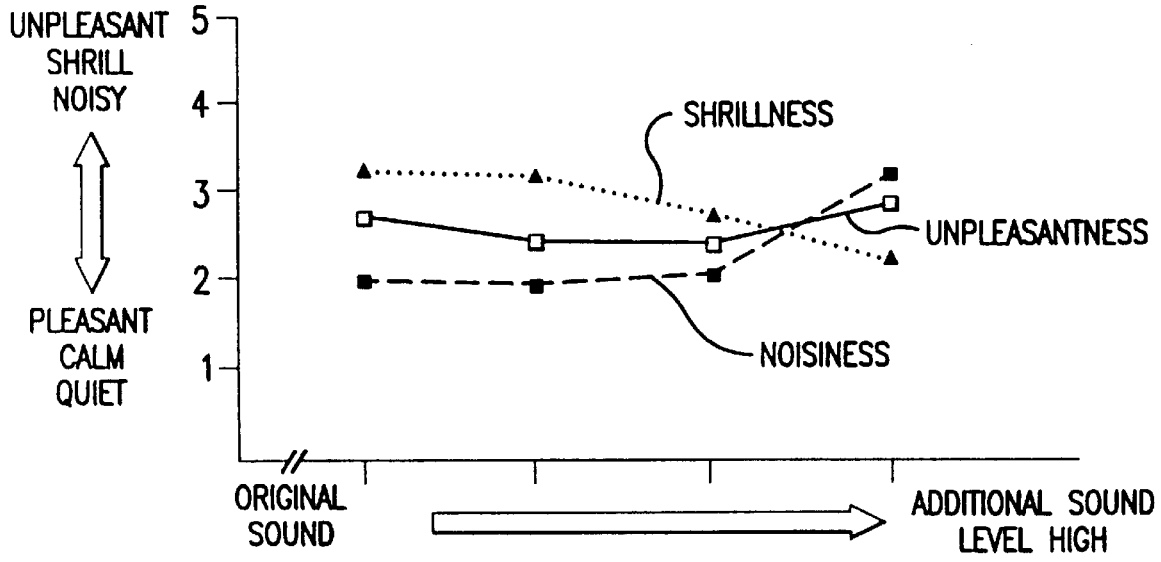
FIG. 11 is a diagram explaining a criterion used in a category evaluation method.
FIG. 12 is a diagram showing evaluation results of a sincere evaluation test conducted in the first embodiment, which results were obtained by the category evaluation method.

For checking the noise masking effect in the above embodiments there were made sincere evaluation tests. In the first sincere evaluation test the construction of the first embodiment was adopted and a noise which had been band-limited so as to contain a main-component frequency of noise generated at the leading edge of revolution of the drive motor 1 was added while changing its level in four stages (including the case where the band noise is not added). The added band noise had such a form as the amplitude of each component was in inverse proportion to frequency. A total of four types of sounds were provided to let eighteen panelists to hear and evaluate with respect to three items—"noisiness," "unpleasantness" and "shrillness". As the evaluation method there was used such a five-stage category evaluation method as shown in FIG. 11. The results obtained are as shown in FIG. 12.

As to the effect obtained by the noise masking system of the first embodiment, it is seen from the graph of evaluation results of FIG. 12 that the evaluation item "unpleasantness" shows a substantially constant tendency even with increase of the added noise level and that the degree of "noisiness" increases as the added noise level becomes higher. As to "shrillness," this evaluation item tends to be mitigated as the added noise level becomes higher, with a maximum of 31% mitigation recognized in comparison with the maximum original sound. From this result it turned out that "shrillness" could be diminished by adding the band-limited noise.

In the second sincere evaluation test there was adopted the construction of the third embodiment and there was added a noise of a band corresponding to a critical band with a main-component frequency of a motor rising noise as the center, the motor rising noise being generated at the leading edge of revolution of the drive motor 1. The band noise amplitude was adjusted so that its energy became equal to the energy of the main-component frequency. Further, the power distribution of the band noise on the frequency axis was adjusted into a triangular distribution. Two types of sounds, one being the motor rising noise plus the band noise and the other being the motor rising noise alone, were provided to let eighteen panelists to hear and evaluate with respect to three items—"noisiness," "unpleasantness" and "shrillness". There was used the same evaluation method as in the first sincere evaluation test, namely, such a five-stage category evaluation method as shown in FIG. 11. The results of the test are as shown in FIG. 13.

Figure 13:
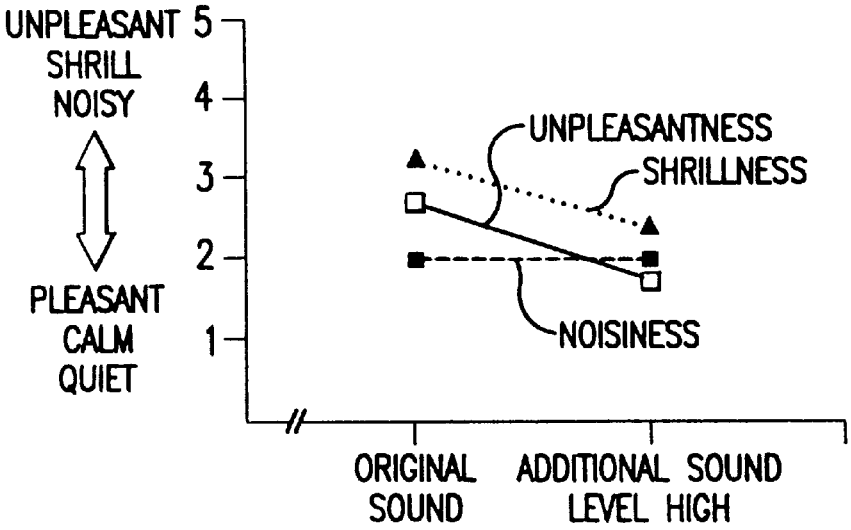
FIG. 13 is a diagram showing evaluation results of a sincere evaluation test conducted in the third embodiment, which results were obtained by the category evaluation method.

According to the noise masking system of the third embodiment, as is seen from the graph of evaluation results of FIG. 13, "noisiness" shows a substantially constant tendency, and "unpleasantness" and "shrillness" are mitigated about 17% and 21%, respectively, in the case of addition of the band noise. From this result it is seen that if a noise of a band corresponding to the critical band of a main-component frequency containing in the noise generated at the leading edge of revolution of the drive motor 1 is added to the motor rising noise, both "unpleasantness" and "shrillness" can be diminished without increase of "noisiness."

According to the noise masking systems of the first to fourth embodiments, asset forth above, a main-component frequency of a noise generated at the leading edge or trailing edge of revolution of the drive motor to a predetermined number of revolutions is detected (the number of revolutions of the drive motor at the leading or trailing edge is detected), a noise band-limited to contain the main-component frequency is produced, and the noise thus produced is outputted as a sound wave. In this case, the amplitude of the band-limited noise is changed according to the operator's desire or is controlled according to the noise loudness detected by the sensor mike, then the band noise is outputted from the speaker as an additional sound to mask the motor rising or trailing noise. Therefore, it is possible to provide an image forming apparatus such as a laser printer or a copying machine of small size and low cost free of any psychological unpleasant feeling based on frequency fluctuation. Further, the number of revolutions of the drive motor at its leading or trailing edge is detected and in accordance with the detected revolutions the band of the noise to be added is limited so as to correspond to the critical band of the main-component frequency, whereby the psychological unpleasant feeling can be mitigated to a further extent.

In the case where the number of revolutions at the leading or trailing edge of the drive motor is detected and the noise to be added is band-limited to the critical band of the main-component frequency in accordance with the detected revolutions, the said band limitation may be substituted by the addition of a pure tone in synchronism with a fluctuating noise of the main-component frequency at the leading or trailing edge of the drive motor. In this case, it is possible to suppress unpleasant feeling based on high-frequency noise although fluctuation is felt. Besides, a simple construction suffices because a pure tone frequency producing circuit can be used as an additional sound generating circuit. Thus, where a high-frequency noise is strong in the motor rising noise, the masking method just mentioned above can be adopted in combination with the masking method adopted in the foregoing embodiments, whereby the psychological unpleasant feeling can be further mitigated. This construction will be described below as the fifth embodiment.

Figure 14:
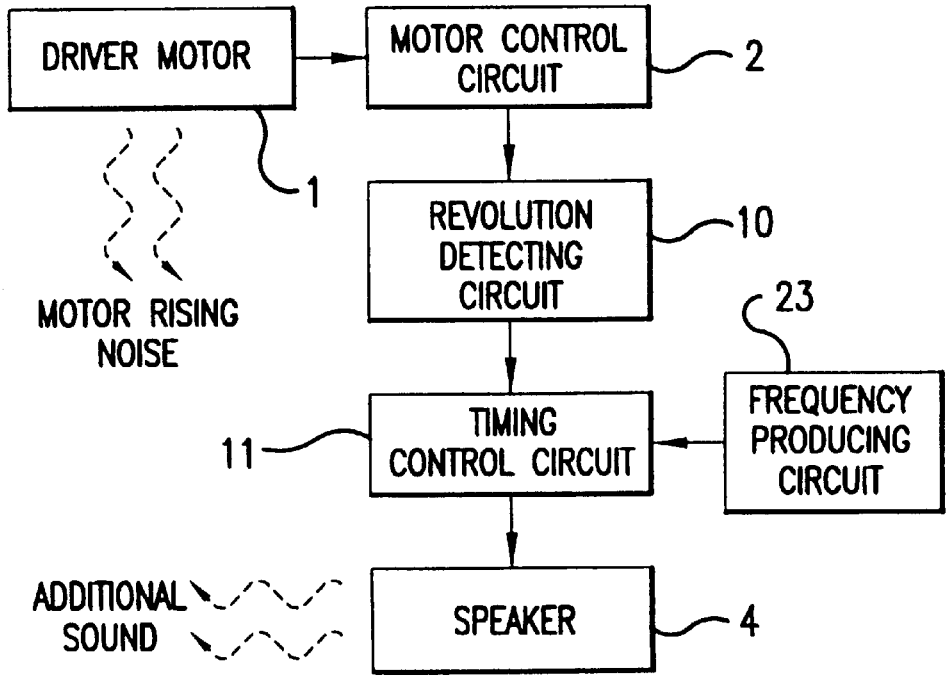
FIG. 14 is a block diagram explaining a noise masking system according to a fifth embodiment of the present invention.

Reference will now be made to the noise masking system of the fifth embodiment. FIG. 14 is a block diagram explaining the construction of the noise masking system of the fifth embodiment. In the same figure, the numeral 1 denotes a drive motor, numeral 2 denotes a motor control circuit, 4 a speaker, 10 a revolution detecting circuit, 11 a timing control circuit, and 23 a frequency producing circuit. In the construction of this fifth embodiment, the band noise generating circuit 3 used in the previous embodiments (first to fourth embodiments) is substituted by a frequency producing circuit 23.

In the noise masking system of the fifth embodiment illustrated in FIG. 14, the motor control circuit 2 acquires from the drive motor 1 a signal related to the motor revolution in order to control the number of revolutions of the drive motor 1. For example, if the drive motor 1 utilizes a magnetic force induced by a permanent magnet as a drive source, a magnetic flux density around the permanent magnet is measured to detect the number of zero points in the flux density, and the number of N-S pole switchings is detected on the basis of the number of zero points. Then, the quotient obtained by dividing the number of N-S pole switchings by the number of poles of the permanent magnet is obtained as a revolution signal of the drive motor 1.

The revolution detecting circuit 10 obtains the revolution signal from the signal obtained by the motor control circuit 2. The revolution signal thus obtained is transmitted from the revolution detecting circuit 10 to the timing control circuit 11 together with the revolution signal which follows one step later. In synchronism with this timing the timing control circuit 11 reads in a pre-stored frequency from the frequency producing circuit 23 and then compares the number of revolutions obtained in the revolution detecting circuit 10 with the number of revolutions during operation of the drive motor 1 which is stored in advance, to detect an operating state of the motor. Further, there is obtained a difference from the revolution signal which follows one step later, to detect the state of the motor at the leading edge.

Then, in synchronism with the change in the number of revolutions continuing from the stand-by condition the timing control circuit 11 sends a signal to the speaker 4, causing the speaker to generate an additional sound (masking sound), allowing the additional sound to be added to the motor rising noise generated from the drive motor 1, to mask the motor rising noise with the additional sound. In this way the noise generated at the leading edge of revolution of the motor is masked. In this case, the additional sound adding timing is the same as that illustrated in FIG. 2.

The following description is now provided about the relation between the change of the additional sound with time and frequency. Three types of noises are mainly generated from the drive motor 1, which are an electromagnetic noise generated from the electromagnetic coil or the iron core at the time of switch-over of an electric current flowing in the drive motor, a wind striking noise induced by friction between a rotary polyhedron mirror and air, and a bearing noise caused by a mechanical shaft-bearing contact. The electromagnetic noise is close to a pure tone having sharp peaks in a narrow frequency band, and the wind striking noise is a hydraulic noise having gentle peaks in a wide frequency band. The bearing noise is close to a pure tone having many sharp peaks based on the shape and size of a ball bearing if used. The bearing noise is not recognized in the case of an air bearing. It is known that the frequencies of these noises are in a proportional relation to the number of revolutions of the drive motor.

Figure 15:
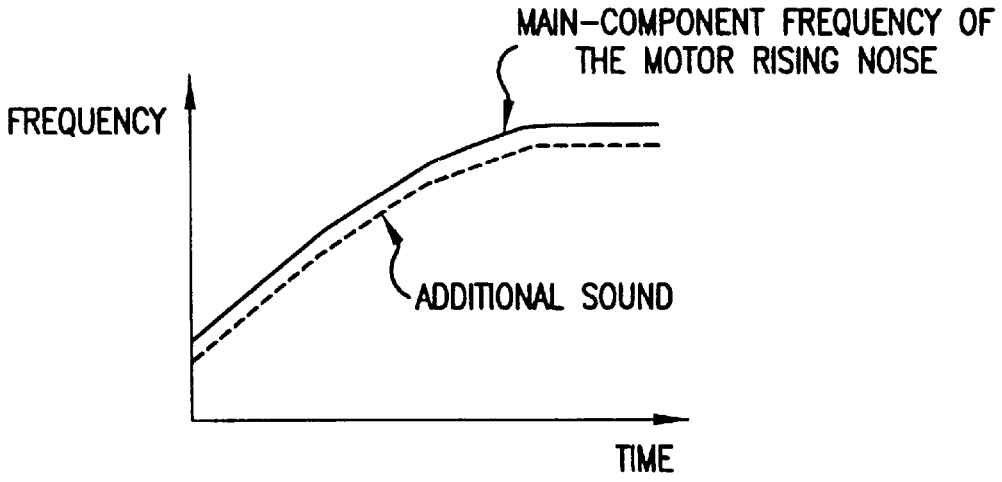
FIG. 15 is a diagram showing a relation between the change of an additional sound with time and a motor rising noise.
Figure 16A:
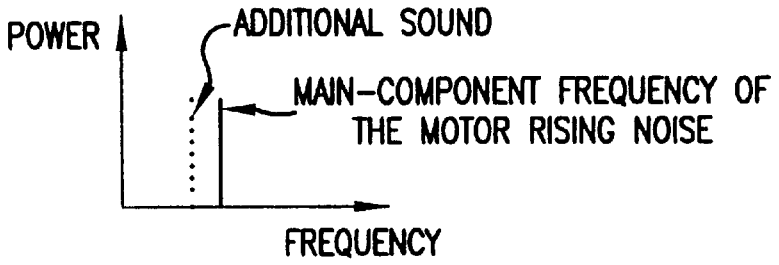
FIG. 16 is a diagram showing an example in which an additional sound is in the form of a pure tone or a form close to a pure tone, having a high or low frequency relative to the main-component frequency of a motor rising noise.
Figure 16B:
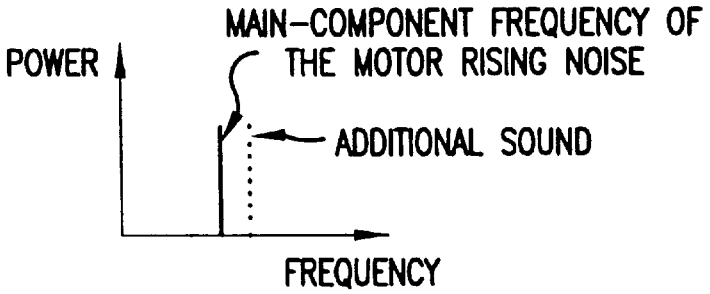

FIG. 15 is a diagram showing a relation between the change of an additional sound with time and a motor rising noise. In the same figure, the curve indicated by a solid line represents fluctuation of a main-component frequency of a noise generated at the leading edge of revolution of the drive motor 1. The drive motor rises from the state of zero revolution or from a stand-by state where the revolution is not zero. On the other hand, the frequency of an additional sound indicated with a broken line is set higher or lower than the main-component frequency of the motor rising noise, which additional sound is added so as not to surpass the noise of the main-component frequency auditorily. Against the motor rising noise, as shown in FIG. 16, the additional sound takes the form of a pure tone or a form close to a pure tone for which the main-component frequency of the motor rising noise is high or low.

Figure 17:
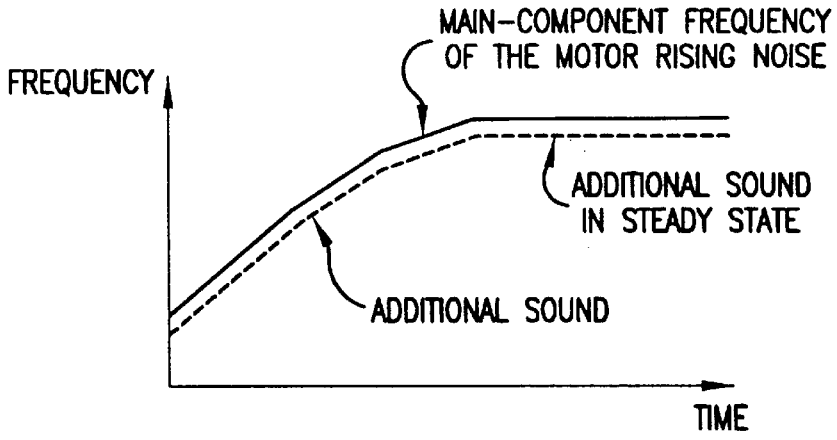
FIG. 17 is a diagram showing an example in which an additional sound is added continuously to the main-component frequency at the leading edge and also to subsequent steady sound.

In order to shorten the rise time of the drive motor 1, the motor control circuit 2 causes a larger current than in the steady state to flow in the drive motor at the initial stage of rise, while when the revolution of the motor approaches a predetermined number of revolutions, the motor control circuit adjusts the electric current small for diminishing overshoot. This fluctuating noise of high frequency which fluctuates with the lapse of time creates a psychologically unpleasant feeling. In the case of a complex sound of several sounds, the way of human feeling of timbre depends on the component sounds, i.e., sounds of added frequency components. In view of this point, to a main-component frequency of noise generated at the leading edge of revolution there is added a sound of a higher or lower frequency than the main-component frequency to widen the frequency band of the noise in excess of the main-component frequency, thereby making the noise difficult to be recognized. In this case, moreover, by adding the additional sound continuously to both motor rising noise and subsequent steady noise, as shown in FIG. 17, it is made possible to make the noise difficult to be recognized in excess of the main-component frequency in a steady state.

In the case where a sound of a higher or lower frequency than the main-component frequency of the motor rising noise is added to the motor rising noise to mask the same noise as in this embodiment, the effect of the masking corresponds to an auditory evaluation of each individual person and therefore the loudness of the additional sound is made adjustable according to an auditory desire of each individual person. This is attained by the sixth embodiment of the present invention.

Figure 18:
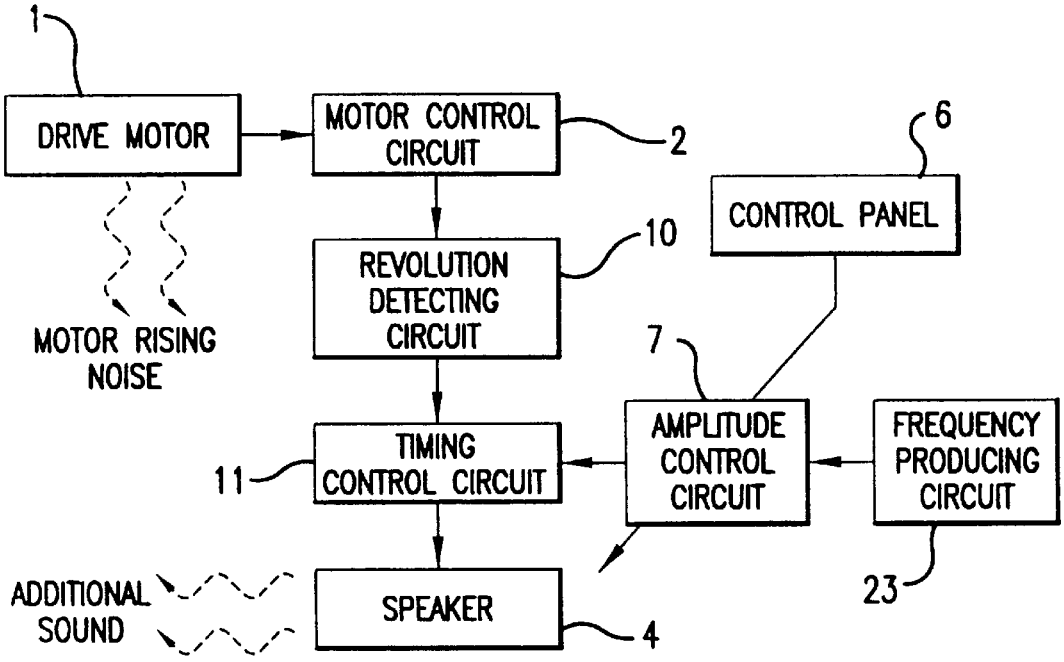
FIG. 18 is a block diagram explaining the construction of a noise masking system according to a sixth embodiment of the present invention.

FIG. 18 is a block diagram explaining the construction of a noise masking system according to the sixth embodiment of the present invention. In the same figure, the numeral 1 denotes a drive motor, numeral 2 denotes a motor control circuit, numeral 4 denotes a speaker, 6*a* control panel, 7 an amplitude changing circuit, 10 a revolution detecting circuit, 11 a timing control circuit, and 23 a frequency producing circuit. These reference numerals are common to those used in the previous embodiments and indicate the same components as in the previous embodiments.

The noise masking system of the sixth embodiment will now be described with reference to FIG. 18. In this sixth embodiment the control panel 6 and the amplitude changing circuit 7 are provided, and the amplitude of an additional sound to be supplied from the frequency producing circuit 23 to the timing control circuit 11 is adjusted by the amplitude changing circuit 7 in accordance with a command provided from the control panel 6.

More specifically, in accordance with a control signal provided from the motor control circuit 2 the revolution detecting circuit 10 detects a change in the number of revolutions at the leading or trailing edge of the drive motor 1 and transmits the detected signal to the timing control circuit 11. With the detected signal as a trigger signal, the timing control circuit 11 generates an additional sound in such a manner that a frequency which has been produced beforehand by the frequency producing circuit 23 is added to a main-component frequency of the noise generated from the motor. In this case, the timing control circuit 11 drives the speaker 4 to output a sound wave as the additional sound while synchronizing the additional sound with time-dependent fluctuations of the main-component frequency. The operator operates the control panel 6 so that a signal for setting a desired amplitude of the additional sound is provided from the control panel to the amplitude changing circuit 7.

The loudness of the additional sound outputted from the speaker 4 is adjusted on the control panel 6 by the operator so as to suit the operator's desire and mitigate the unpleasant feeling of noise generated from the image forming apparatus. An appropriate signal is provided from the control panel 6 to the amplitude changing circuit 7, which in turn changes the amplitude of the sound to be used as the additional sound in accordance with the received signal and causes the sound to be outputted as a sound wave from the speaker 4. This sound wave is added to the main-component frequency. Thus, on the control panel 6 the operator can adjust the recognition degree of noise to the extent that the noise of the main-component frequency is not recognized by the operator and people present around the operator. Moreover, it is possible to suppress unpleasant feeling according to the desire of each individual person.

In the sixth embodiment described above, in the case of adding an additional sound to the motor rising noise to mask the noise, the loudness of the additional sound can be adjusted according to an auditory desire of each individual person. However, this is complicated because the adjustment must be made separately for each noise. For eliminating this complicatedness it is possible to constitute the noise masking system so as to permit this adjustment to be done automatically, whereby the amplitude of the additional sound for masking the noise can be adjusted automatically. Further, minute adjustments may be made according to the desire of each individual person as in the sixth embodiment. A noise masking system having such a construction will be described below as the seventh embodiment.

Figure 19:
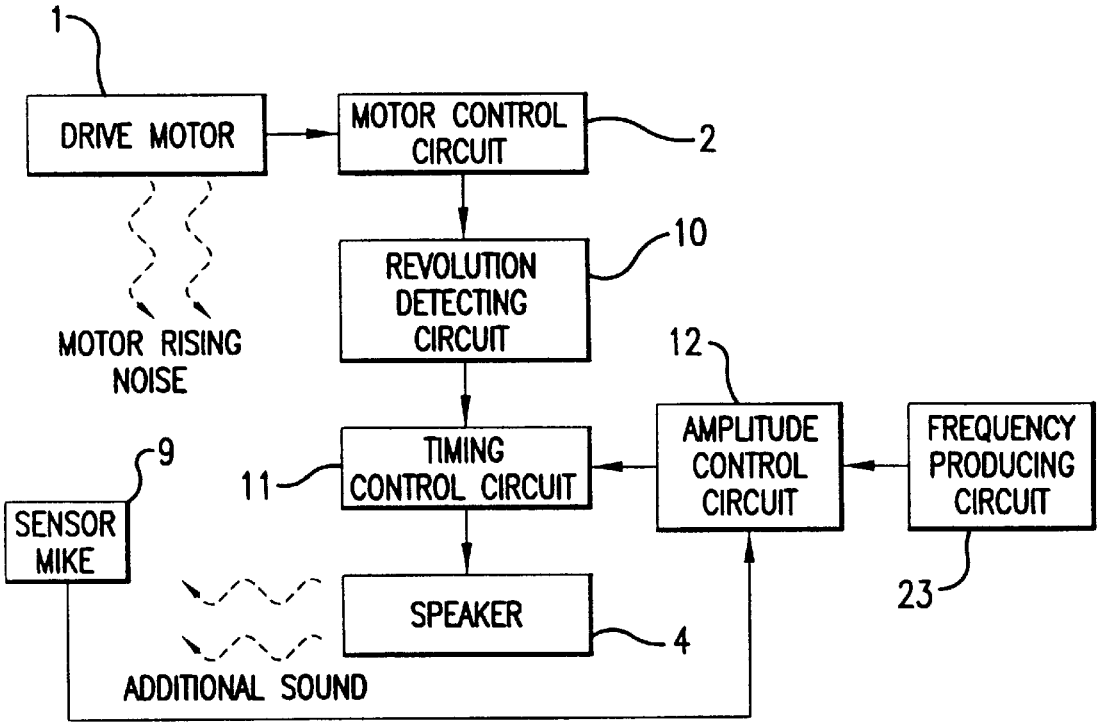
FIG. 19 is a block diagram explaining the construction of a noise masking system according to a seventh embodiment of the present invention.

FIG. 19 is a block diagram explaining the construction of a noise masking system according to the seventh embodiment of the present invention. In the same figure, the numeral 1 denotes a drive motor, numeral 2 denotes a motor control circuit, numeral 4 denotes a speaker, 10 a revolution detecting circuit, 11 a timing control circuit, and 23 a frequency producing circuit. These components are the same as in the fifth embodiment (FIG. 14). Further, the numeral 9 denotes a sensor mike for sensing a motor rising noise generated from the drive motor 1 and numeral 12 denotes an amplitude control circuit.

The noise masking system of the seventh embodiment will now be described with reference to the block diagram of FIG. 19. In the seventh embodiment the amplitude control circuit 12 and the sensor mike 9 are provided in addition to the components of the fifth embodiment (FIG. 14). The sensor mike 9 detects the amplitude of a main-component frequency of a motor rising noise, and in accordance with this detected signal the amplitude control circuit 12 adjusts the amplitude of an additional signal automatically. More specifically, the amplitude of an additional sound having plural frequencies, which is provided from the frequency producing circuit 23 to the timing control circuit 11, is adjusted automatically by the amplitude control circuit 12 in accordance with the detected output provided from the sensor mike 9.

Thus, in the seventh embodiment illustrated in FIG. 19, the construction of the sixth embodiment illustrated in FIG. 18 is further developed and there is provided the sensor mike 9 for sensing the motor rising noise. Also provided is the amplitude control circuit 12 which corresponds to the amplitude changing circuit 7 used in the sixth embodiment. In this construction, the amplitude of a main-component frequency contained in the motor rising noise is detected continually by the sensor mike 9 and the detected signal is transmitted to the amplitude control circuit 12, which in turn controls actively an increase or decrease in amplitude of the additional sound against time-dependent fluctuations of the main-component frequency. In this way the amplitude is maintained in a predetermined state in response to environmental changes of the main-component frequency and changes of various conditions, whereby the suppression of unpleasant feeling can be done stably.

EXPERIMENT 2

In order to check the noise masking effect of the fifth to seventh embodiments described above there was made evaluation in terms of sincere evaluation tests. More specifically, using a drive motor with a main-frequency component rising from 800 Hz to 3200 Hz in five seconds, there was produced a fluctuating complex sound with a pure tone added synchronously, the pure tone being lower in frequency by 100 to 200 Hz than the main-component frequency. Eighteen panelists heard the fluctuating complex sound and evaluated with respect to three items—"noisiness," "unpleasantness" and "shrillness". As the evaluation method there was used such a seven-stage category evaluation method as shown in FIG. 20. The results obtained are as shown in FIG. 21.

Figure 21:
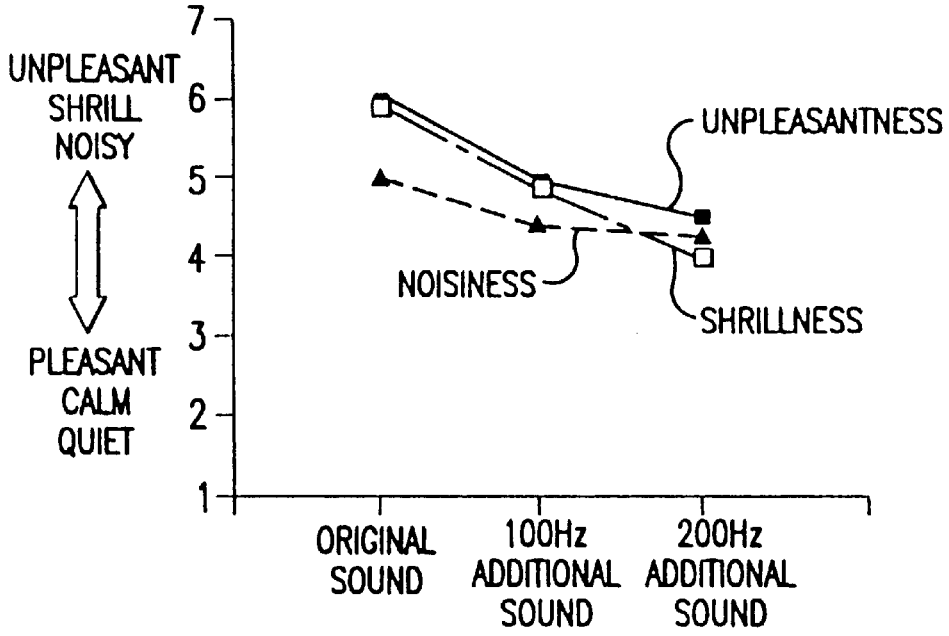
FIG. 21 is a diagram showing evaluation results of a noise masking sincere evaluation test, which results were obtained by the seven-stage category evaluation method.

According to the noise masking system of these embodiments, as shown in FIG. 21, "unpleasantness" was diminished a maximum of 25% in comparison with the original sound, and "shrillness" was diminished a maximum of 32% in comparison with the original sound. As to "noisiness" there was little change. According to the panelists, they felt noise fluctuation, but the noise itself was scarcely unpleasant.

Thus, from the results of this experiment it turned out that by adding the pure tone to the main-component frequency of noise generated at the leading edge of revolution of the drive motor both "shrillness" and "unpleasantness" could be diminished without increase of "noisiness."

Thus, according to the noise masking systems of the fifth to seventh embodiments, a main-component frequency of noise generated at the time of rise to a predetermined number of revolutions of the drive motor is detected, then a leading or trailing number of revolutions of the drive motor is detected, a frequency higher or lower than the main-component frequency is produced, the sound of the frequency thus produced is outputted from the speaker while controlling its timing so as to be synchronized with fluctuations of the main-component frequency with the lapse of time, and this sound from the speaker is added to the motor rising noise to mask the noise. In this case, the amplitude of the additional sound is changed as desired or is controlled according to the loudness of the noise detected by the sensor mike. In this way, the sound of a higher or lower frequency than the main-component frequency is outputted as a noise masking additional sound from the speaker in synchronism with time-dependent fluctuations of the main-component frequency, whereby it is possible to provide an image forming apparatus such as a laser printer or a copying machine of small size and low cost, not giving rise to any psychological unpleasant feeling based on a high-frequency fluctuating noise.

In the fifth to seventh embodiments the number of revolutions at the leading or trailing edge of revolution of the drive motor is detected and a higher or lower frequency than the main-component frequency is generated according to the detected number of revolutions and is added as a masking sound to the motor rising noise in synchronism with time-dependent fluctuations of the main-component frequency. In this case, even if the sound of a higher or lower frequency than the main-component frequency is not changed according to the main-component frequency, if it is a sound of a certain frequency falling under the fluctuation range of the main-component frequency, it is possible to make the fluctuating noise at the leading or trailing edge of motor revolution difficult to hear to a satisfactory extent and thereby suppress the psychological unpleasant feeling.

In this case, by eliminating time-dependent fluctuations of frequency, the secondary sound generated as a masking sound permits a recognizable noise to be heard as a steady sound, whereby the fluctuating frequency noise of the drive motor can be rendered difficult to hear and hence it is possible to suppress the psychological unpleasant feeling. Besides, by making the frequency of the masking sound to be added to the motor rising noise equal to the main-component frequency in steady operation, it is possible to stop the generation of the added masking sound without causing any incongruity sense during processing operation. Further, it is possible to suppress power consumption during the operation. Description will be directed below to an embodiment having such a construction.

Figure 22:
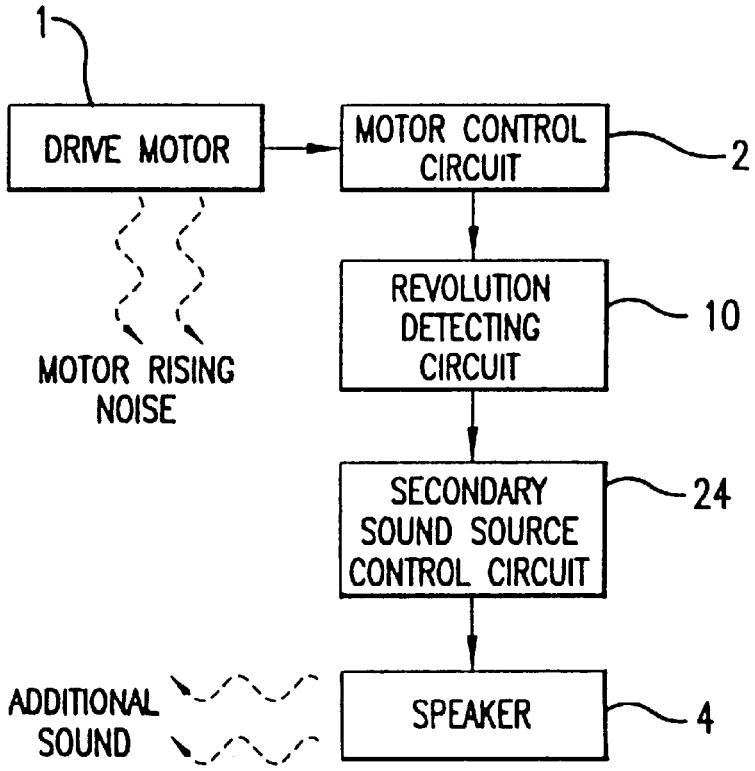
FIG. 22 is a block diagram explaining the construction of a noise masking system according to an eighth embodiment of the present invention.

FIG. 22 is a block diagram explaining the construction of a noise masking system according to an eighth embodiment of the present invention. In the same figure, the numeral 1 denotes a drive motor, numeral 2 denotes a motor control circuit, 4 a speaker, 10 a revolution detecting circuit, and 24 a secondary sound source control circuit. In the construction of this eighth embodiment, the secondary sound source control circuit 24 is provided in place of the timing control circuit 11 and the frequency producing circuit 23 both used in the fifth embodiment.

In the noise masking system of the eighth embodiment illustrated in FIG. 22, the motor control circuit 2, for controlling the number of revolutions of the drive motor 1, acquires a signal related to the number of revolutions from the drive motor 1. For example, if the drive motor 1 utilizes a magnetic force created by a permanent magnet as a drive source, a magnetic flux density around the permanent magnet is measured to detect the number of zero points of the flux density, thereby detecting the number of N-S pole switchings, and the quotient obtained by dividing the number of N-S pole switchings by the number of poles of the permanent magnet is obtained as a motor revolution signal.

Thus, the revolution detecting circuit 10 obtains the revolution signal from the signal obtained by the motor control circuit 2. The revolution signal is then fed from the revolution detecting circuit 10 to the secondary sound source control circuit 24 together with the revolution signal which follows one step later. The secondary sound source control circuit 24 compares the number of revolutions detected by the revolution detecting circuit 10 with a pre-stored number of revolutions of the drive motor 1 during operation, and thereby detects an operating condition. Further, by taking a difference from the revolution signal which follows one step later, the secondary sound source control circuit becomes aware of the motor rising state.

When there is a change in the number of revolutions from the stand-by state, the secondary sound source control circuit 24 sends a signal to the speaker 4, causing the speaker to output an additional sound (masking sound), which additional sound is added to the motor rising noise generated from the drive motor 1. In this way the motor rising noise is masked by the additional sound. The additional sound adding timing is the same as that shown in FIG. 2.

Reference will now be made to the relation between the change with time of the additional sound and frequency. Three types of noises are mainly generated from the drive motor 1, which are an electromagnetic noise generated from the electromagnetic coil or iron core at the time of switch-over of an electric current flowing in the drive motor, a wind striking noise generated by friction between a rotary polyhedron mirror and air, and a bearing noise generated by a mechanical shaft-bearing contact. The electromagnetic noise is close to a pure tone having sharp peaks in a narrow frequency band, and the wind striking noise is a hydraulic noise having gentle peaks in a wide frequency band. The bearing noise is close to a pure tone having many peaks according to the shape and size of a ball bearing if used. In the case of an air bearing, noise is not recognized. It is known that the frequencies of these noises are in a proportional relation to the number of revolutions of the drive motor.

Figure 23:
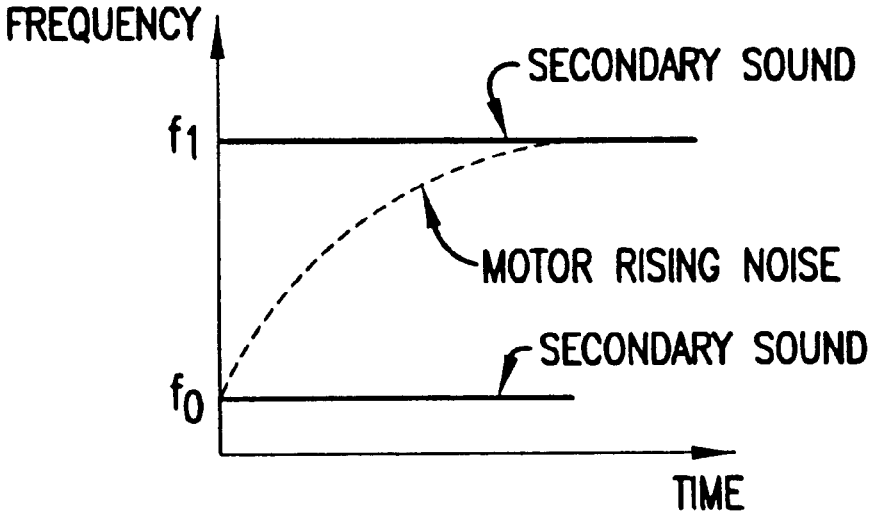
FIG. 23 is a diagram showing a relation between the change with time of an additional sound added as a masking sound and a motor rising noise.
Figure 24:
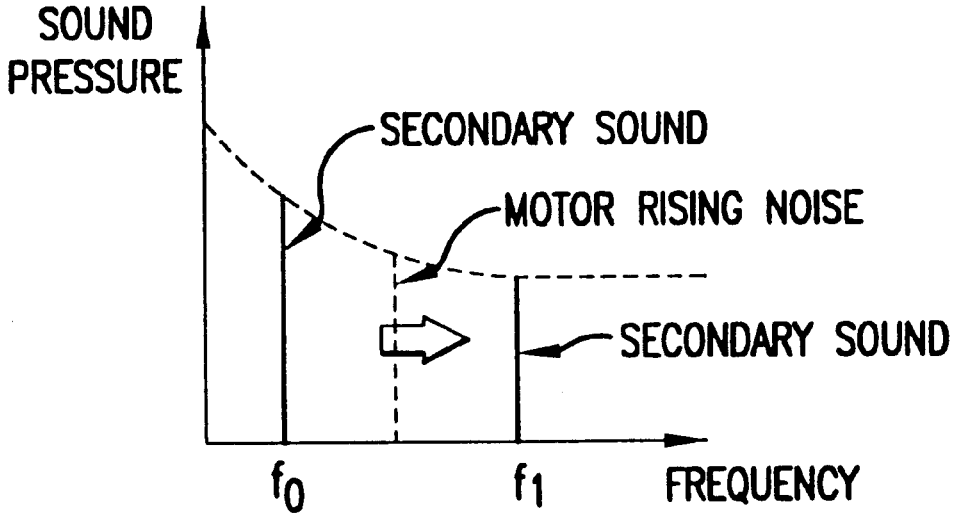
FIG. 24 is a diagram explaining a frequency characteristic of a sound having a frequency to be used as a secondary masking sound.

FIG. 23 is a diagram showing a relation between the change with time of an additional sound added as a masking sound and a motor rising noise. In the same figure, the curve indicated with a broken line represents the change of a main-component frequency of a noise generated when the revolution of the drive motor 1 rises. The revolution of the drive motor rises from zero or from a stand-by mode wherein the number of revolution is not zero. On the other hand, as to the frequency of a masking sound (secondary sound), both higher and lower frequencies than the main-component frequency of the motor rising noise can be utilized as indicated with solid lines. The masking sound is a steady sound which does not fluctuate with the lapse of time. Against the motor rising noise, as shown in FIG. 24, the sound pressure of the secondary sound for masking is set so that the higher the frequency, the lower the sound pressure.

As mentioned previously, in order to shorten the rise time of the drive motor 1, the motor control circuit 2 makes control in such a manner that a larger electric current than in the steady state of the motor is allowed to flow at the initial stage of the motor revolution and that as the motor revolution approaches a predetermined number of revolutions, the electric current is adjusted to a small current for diminishing overshoot. Therefore, such a fluctuating noise of high frequency which fluctuates with the lapse of time gives rise to a psychological unpleasant feeling. In the case of a complex sound of several sounds, the timbre audible to a human is influenced by both minimum and maximum frequency components and hence the fluctuating noise off frequency is made difficult to hear by adding a secondary sound of a higher or lower frequency than the main-component frequency of the motor rising noise.

In this eighth embodiment it is assumed that the revolution of the drive motor rises from the stand-by mode wherein the number of revolution is not zero. However, in the case where the drive motor is OFF in the stand-by mode, it is impossible to establish a lower frequency of a secondary sound relative to the motor rising noise. In this case, a lower frequency than the main-component frequency in several seconds after the rise of motor revolution should be established, whereby there is obtained an effect almost equal to that obtained above except the period just after the rise of motor revolution.

In this case, moreover, by making the secondary sound into a stationary sound whose frequency does not fluctuate with the lapse of time, it becomes possible to render the frequency fluctuating noise more difficult to hear and thus possible to enhance the noise masking effect. In the eighth embodiment a stationary sound whose frequency does not fluctuate with the lapse of time is used as the additional sound. For example, however, even by the addition of a sound small in the rate of change to the motor rising noise, it is possible to expect a certain degree of effect.

During steady operation of the drive motor it is not necessary to generate the secondary sound because a fluctuating noise of frequency does not occur. Therefore, by making the frequency of the secondary sound equal to the number of revolutions of the drive motor in steady operation (processing operation), it becomes possible to stop the generation of the secondary sound without causing any incongruity sense. Consequently, it is possible to prevent increase in power consumption during the processing operation. Further, against the main-component frequency of the motor rising noise, if the sound pressure of the secondary sound as a masking sound is settled so that the lower the frequency, the lower the sound pressure, that is, if frequency and reciprocal sound pressure are rendered proportional to each other, it is no longer possible that only a specific frequency will be conspicuous in the auditory sense, and therefore the psychological unpleasant feeling can be suppressed to a further extent.

Figure 25:
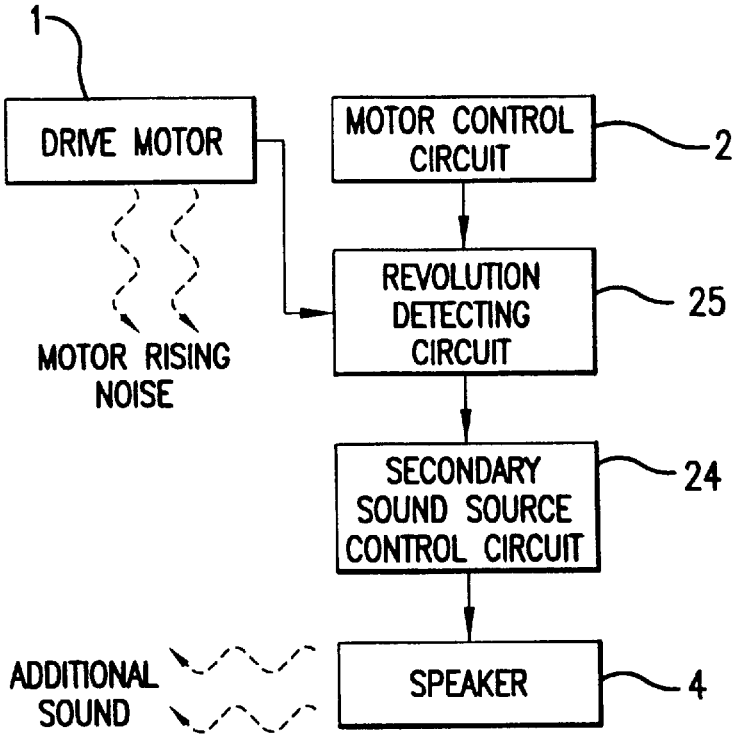
FIG. 25 is a diagram explaining the construction of a noise masking system according to a ninth embodiment of the present invention.

Now, a description will be given of a modification of the eighth embodiment. Although in the noise masking system of the eighth embodiment the revolution detecting circuit 10 acquires a revolution signal from a signal provided from the motor control circuit 2, a modification may be made so as to obtain the former signal directly from a signal provided from the drive motor 1. A noise masking system according to this modification is illustrated in FIG. 25. In the same figure, the numeral 1 denotes a drive motor, numeral 2 denotes a motor control circuit, 4 a speaker, 24 a secondary sound source control circuit, and 25 a modified revolution detecting circuit.

Figure 26:
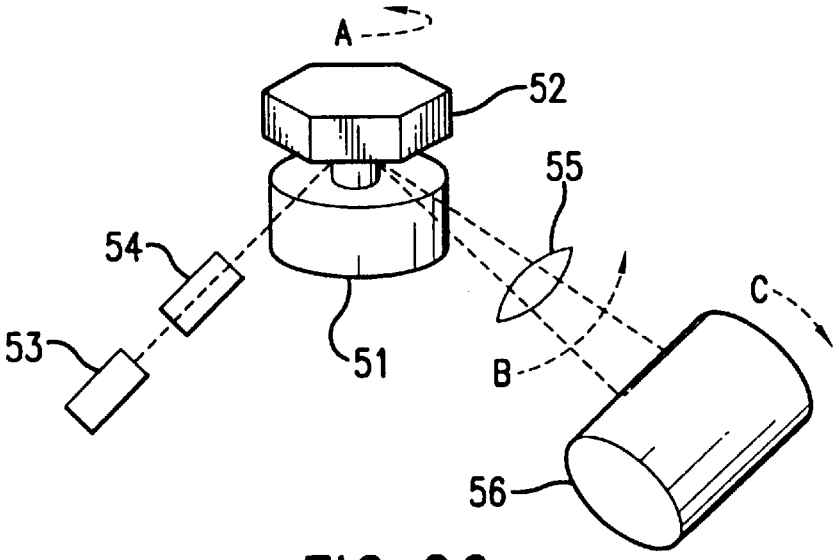
FIG. 26 PRIOR ART
FIG. 26 is a perspective view explaining the construction of an optical deflector (optical scanner)
Figure 27:
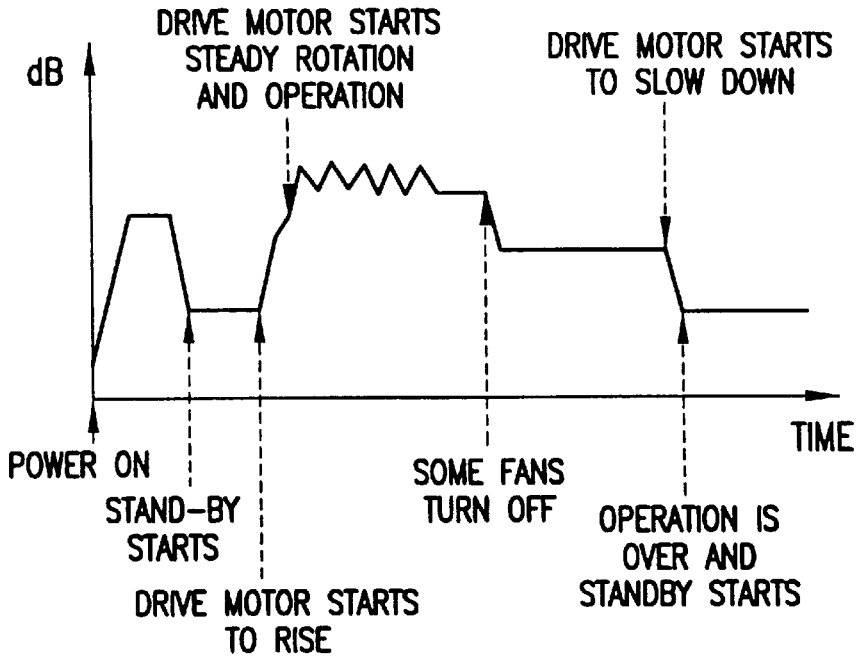
FIG. 27 PRIOR ART
FIG. 27 is a diagram explaining the change of noise generated in a series of processes in a copying machine.
Figure 28:
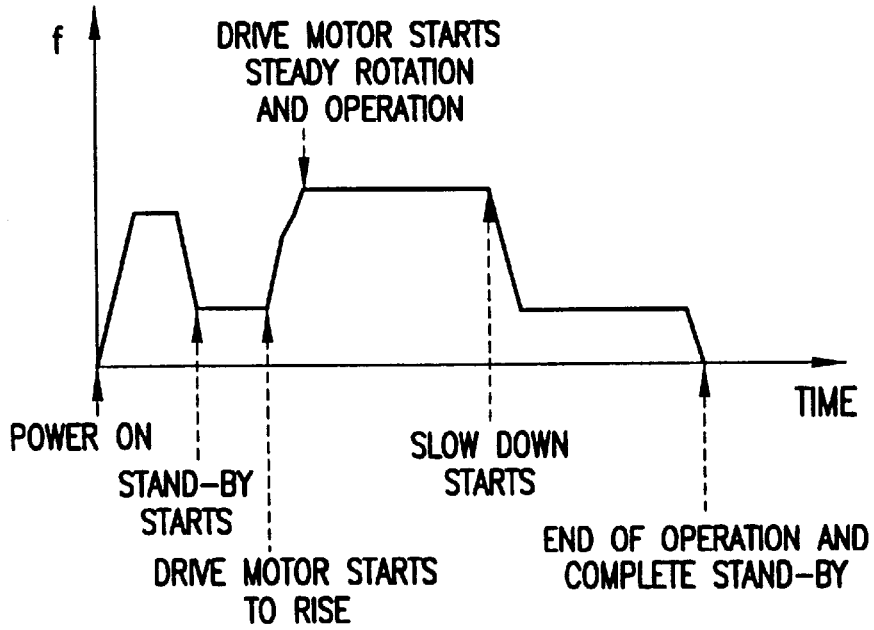
FIG. 28 PRIOR ART
FIG. 28 is a diagram explaining the change in the number of revolutions of a drive motor in a series of processes in the copying machine.

In this modification, as a ninth embodiment of the present invention, the revolution detecting circuit 25 directly uses a signal provided from the drive motor 1 and does not use a signal provided from the motor control circuit 2, as shown in FIG. 25. For example, since the drive motor 1 is a part of an optical deflector (optical scanner), as shown in FIG. 26, by providing a part or the outside of the recording member 56 with a light beam sensor such as a photosensor, it becomes possible for the revolution detecting circuit 25 to acquire revolution information directly. This ninth embodiment is characteristic in that a second sound generating mechanism can be constituted separately from the drive motor 1. This is advantageous in that the maintainability is improved and the freedom of design is enhanced.

In the noise masking system according to the present invention, asset forth hereinabove, the number of revolutions the leading or trailing edge of revolution of the drive motor is detected correspondingly to a main-component frequency of noise generated at the time of rise to a predetermined number of revolutions of the drive motor or at the time of fall thereof, then on the basis of the detected number of revolutions there is produced, for example, a band-limited noise as a masking sound having a frequency range including the main-component frequency, and the band-limited noise is outputted from the speaker. Consequently, it is possible to provide an image forming apparatus such as a laser beam printer or a copying machine of a small size and low cost, not giving rise to any psychological unpleasant feeling based on frequency fluctuation.

What is claimed is:

1. A noise masking system in an image forming apparatus having a drive motor, said noise masking system comprising:

a speaker for outputting a masking sound to mask a noise generated from said drive motor; and masking sound control means which causes said speaker to output a masking sound of a frequency range including a main-component frequency corresponding to a sound pressure peak of the noise, wherein the masking sound masks the noise of the drive motor without decreasing the sound pressure of the noise.

2. A noise masking system according to claim 1, wherein said masking sound is a noise type masking sound not having any outstanding sound pressure peak in a specific frequency.

3. A noise masking system according to claim 1, wherein said masking sound is a pure tone masking sound having an outstanding sound pressure peak in a specific frequency.

4. A noise masking system according to claim 2, wherein the frequency and sound pressure of said noise type masking sound are in inverse proportion to each other.

5. A noise masking method for an image forming apparatus having a drive motor, which method comprising:

producing a correlation signal correlated with the number of revolutions of said drive motor;

changing a masking sound for masking a noise generated from said drive motor, in response to a change of said correlation signal; and outputting the thus-changed masking sound from a speaker, wherein the masking sound masks the noise of the drive motor without decreasing the sound pressure of the noise.

* * * * *